US009677296B2

(12) United States Patent
Smith

(10) Patent No.: US 9,677,296 B2
(45) **Date of Patent: *Jun. 13, 2017**

(54) ANCHOR POST

(71) Applicant: Anchor Systems (International) Ltd., Rowfant (GB)

(72) Inventor: Ewan R. Smith, Crawley (GB)

(73) Assignee: ANCHOR SYSTEMS (INTERNATIONAL) LIMITED, Rowfant (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/841,498

(22) Filed: Aug. 31, 2015

(65) Prior Publication Data

US 2015/0368923 A1 Dec. 24, 2015

Related U.S. Application Data

(63) Continuation of application No. 14/578,083, filed on Dec. 19, 2014, now Pat. No. 9,151,070, which is a (Continued)

(30) Foreign Application Priority Data

May 27, 2008 (EP) ..... 08251833

(51) Int. Cl.

| | |
|---|---|
| ***E04H 17/22*** | (2006.01) |
| ***E04H 12/22*** | (2006.01) |
| ***E02D 5/28*** | (2006.01) |
| ***E04H 12/02*** | (2006.01) |
| ***E04H 12/08*** | (2006.01) |
| ***E04H 12/34*** | (2006.01) |

(52) U.S. Cl.
CPC ..... *E04H 12/2215* (2013.01); *E02D 5/28* (2013.01); *E04H 12/02* (2013.01); *E04H 12/085* (2013.01); *E04H 12/347* (2013.01)

(58) Field of Classification Search
CPC ..... E04H 17/00; E04H 17/22; E04H 12/2215; A45F 3/44
USPC ..... 52/155, 165, 169.13, 170, 831, 848
See application file for complete search history.

(56) References Cited

U.S. PATENT DOCUMENTS

| | | | |
|---|---|---|---|
| 210,648 | A | 12/1878 | Turner |
| 233,565 | A | 10/1880 | Shriver |

(Continued)

FOREIGN PATENT DOCUMENTS

| | | | |
|---|---|---|---|
| EP | 2042659 | A1 | 4/2009 |
| GB | 2068037 | A | 8/1981 |

(Continued)

OTHER PUBLICATIONS

Anchor Systems (Europe), Ltd., Geotechnical and Structural Stabilisation Brochure by Ewan R. Smith, Nov. 21, 2008, United Kingdom.

(Continued)

*Primary Examiner* — Beth Stephan
(74) *Attorney, Agent, or Firm* — Wilson Sonsini Goodrich & Rosati

(57) ABSTRACT

Provided herein are methods, devices and systems comprising an anchor post that has a shaft, at least one stabilizing element attached to the anchor post configured to resist movement of the anchor post, and at least one alignment element.

18 Claims, 9 Drawing Sheets

Related U.S. Application Data continuation of application No. 14/265,239, filed on Apr. 29, 2014, now Pat. No. 9,003,722, which is a continuation of application No. 13/931,734, filed on Jun. 28, 2013, now abandoned, which is a continuation of application No. 13/419,330, filed on Mar. 13, 2012, now abandoned, which is a continuation of application No. 12/372,965, filed on Feb. 18, 2009, now Pat. No. 8,156,695.

(56) References Cited

U.S. PATENT DOCUMENTS 286,182 A 10/1883 Cunningham et al.
2,149,050 A * 2/1939 Hajicck ..... A47G 29/1216 232/39
2,647,593 A 8/1953 Holman
3,011,597 A 12/1961 Galloway et al.
3,066,447 A * 12/1962 Reiterer ..... A01G 9/124 47/47
3,066,769 A * 12/1962 Pasquale ..... E04H 12/2215 248/156
3,342,444 A * 9/1967 Nelson ..... E04H 12/2215 248/156
3,969,853 A * 7/1976 Deike ..... E02D 5/803 52/154
4,530,190 A 7/1985 Goodman
4,603,520 A * 8/1986 Deike ..... E04H 17/08 52/157
4,649,678 A * 3/1987 Lamson ..... E04H 12/2215 248/530
4,803,812 A 2/1989 Alexander, Sr.
4,926,592 A 5/1990 Nehls
5,011,107 A * 4/1991 Reece ..... E04H 12/2223 248/156
5,060,908 A 10/1991 Sofy
5,224,310 A 7/1993 Edwards et al.
5,307,598 A 5/1994 West
5,524,855 A * 6/1996 Lesar ..... E04H 12/2215 135/16
5,613,329 A 3/1997 Land et al.
5,713,514 A * 2/1998 Eck ..... A47G 29/1216 232/17
5,884,874 A * 3/1999 Speece ..... E04H 12/2284 248/156
5,927,677 A 7/1999 Speece et al.
5,975,808 A * 11/1999 Fujita ..... E02D 5/28 405/244
RE36,550 E 2/2000 West
6,032,880 A * 3/2000 Verrills ..... E04H 12/2223 248/156
6,058,662 A * 5/2000 Perko ..... E02D 5/801 405/232
6,273,390 B1 * 8/2001 Meyer ..... E04H 12/2284 248/507
6,343,446 B1 * 2/2002 Beard ..... E04H 12/2215 248/545
6,540,196 B1 * 4/2003 Ellsworth ..... E01F 9/0182 248/548
6,722,821 B1 * 4/2004 Perko ..... E02D 5/801 405/249
6,895,613 B1 * 5/2005 Clouston ..... E04H 15/62 135/118
7,007,910 B1 * 3/2006 Krinner ..... E04H 12/2223 248/156
7,172,163 B1 * 2/2007 Johnson ..... A47G 29/1216 232/39
D543,438 S 5/2007 Walker
7,219,872 B2 * 5/2007 Walker ..... E04H 12/2215 248/156
7,364,066 B1 * 4/2008 Wilson ..... A47G 29/1209 232/17
7,832,695 B2 * 11/2010 Ebel ..... A45F 3/44 248/156
8,156,695 B2 * 4/2012 Smith ..... E02D 5/28 52/154
9,003,722 B2 4/2015 Smith
9,151,070 B2 * 10/2015 Smith ..... E04H 12/2215
2002/0098045 A1 * 7/2002 Fukushima ..... E02D 5/28 405/253
2004/0103599 A1 * 6/2004 Keck ..... E02D 5/801 52/155
2004/0169121 A1 * 9/2004 Winn ..... A45B 1/00 248/530
2004/0221543 A1 * 11/2004 Eleas ..... E02D 5/56 52/153
2006/0060730 A1 * 3/2006 Walker ..... E04H 12/2269 248/156
2007/0000187 A1 1/2007 St. Onge et al.
2007/0120035 A1 5/2007 Albanese et al.
2009/0293379 A1 * 12/2009 Smith ..... E02D 5/28 52/154
2011/0036025 A1 * 2/2011 Boulay ..... E02D 5/801 52/157
2011/0047896 A1 * 3/2011 Vosbikian ..... E04H 12/2215 52/165
2011/0314749 A1 * 12/2011 Rainer ..... E04H 12/2223 52/157
2012/0167489 A1 7/2012 Smith

FOREIGN PATENT DOCUMENTS

GB 2397327 A 7/2004
WO WO-8910514 A1 11/1989
WO WO-9318253 A1 9/1993
WO WO-9914441 A1 3/1999
WO WO-2005010300 A1 2/2005
WO WO-2010095007 A1 8/2010

OTHER PUBLICATIONS

Anchor Systems (Europe), Ltd., Revolutionary Anchor Post System Brochure by Ewan R. Smith, Nov. 21, 2008, United Kingdom.
AU2013267011 Australian Office Action dated Aug. 28, 2015.
European Patent Application No. 08251833 Search Report mailed Oct. 10, 2008.
European Patent Application No. 09786337.7 Communication dated Jul. 31, 2015.
Office action dated Feb. 6, 2015 for U.S. Appl. No. 14/578,083.
Office action dated Jan. 19, 2011 for U.S. Appl. No. 12/372,965.
Office action dated Jul. 8, 2014 for U.S. Appl. No. 14/265,239.
Office action dated Jun. 24, 2010 for U.S. Appl. No. 12/372,965.
Office action dated May 10, 2011 for U.S. Appl. No. 12/372,965.
Office action dated Oct. 20, 2014 for U.S. Appl. No. 14/265,239.
Office action dated Oct. 31, 2013 for U.S. Appl. No. 13/931,734.
PCT/IB2009/51163 International Preliminary Report on Patentability dated Sep. 1, 2011.
PCT/IB2009/51163 International Search Report dated Jan. 22, 2010.
PCT/IB2009/51163 Partial International Search Report dated Nov. 16, 2009.
PCT/IB2009/51163 Written Opinion dated Aug. 18, 2011.
Photograph of traditional cable support systems for the London Underground, Jan./Feb. 2007.

* cited by examiner

ANCHOR POST

CROSS REFERENCE

This application is a continuation of U.S. application Ser. No. 14/578,083 filed Dec. 19, 2014 which is a continuation of U.S. application Ser. No. 14/265,239 filed Apr. 29, 2014 (issued as U.S. Pat. No. 9,003,722 on Apr. 14, 2015) which is a continuation of U.S. application Ser. No. 13/931,734 filed Jun. 28, 2013, now abandoned, which is a continuation of U.S. application Ser. No. 13/419,330 filed Mar. 13, 2012, now abandoned, which claims the benefit of U.S. application Ser. No. 12/372,965 filed Feb. 18, 2009 (issued as U.S. Pat. No. 8,156,695 on Apr. 17, 2012) which claims the right of priority under 35 U.S.C. §119(a)-(d) of European Patent Application No. 08251833.3 filed May 27, 2008, the disclosure of each of which are considered a part of and are hereby incorporated by reference into the disclosure of this application in their entirety.

BACKGROUND OF THE INVENTION

A more robust, efficient, and practical device, method and system is needed for installing anchor posts into the ground and for providing enhanced stability and support to a load post. Described herein are technologies that in some embodiments offer a completely integrated system by which appropriate personnel can efficiently install an anchor post into the ground and provide support and stability to a load post for various applications, including construction applications.

SUMMARY OF THE INVENTION

In one aspect, provided herein is an anchor post comprising: (a) a shaft; (b) at least one stabilising element attached to the anchor post configured to resist movement of the anchor post; and (c) at least one alignment element.

In an additional aspect, provided herein is an anchor post comprising: (a) a shaft; (b) at least one stabilising element attached to the anchor post configured to resist movement of the anchor post; and (c) at least one alignment element that is configured to connect to at least one load post without inserting a substantial portion of the load post into the anchor post.

In another aspect, provided herein is an anchor post comprising a shaft and at least one stabilising element attached to the anchor post, wherein the anchor post is configured for installation into a displaceable ground material at a drive-rate of at least about 5 millimeters of anchor post per second when about 3 kN of force is applied to the head of the anchor post.

In a further aspect, provided herein is a method of installing an anchor post into the ground comprising driving into the ground an anchor post, wherein the anchor post comprises a shaft, at least one stabilising element attached to the anchor post configured to resist movement of the anchor post, and at least one alignment element.

In one aspect, provided herein is an anchor post comprising a shaft and at least one stabilising element attached to the anchor post, wherein the anchor post is at least about 50 millimeters in length measured from head tip to tail tip.

In another aspect, provided herein is an anchor post comprising a shaft and at least one stabilising element, wherein the anchor post is manufactured out of a versatile material.

In yet another aspect, provided herein is an anchor post comprising: (a) a shaft that is configured to receive a drive rod; and (b) at least one stabilising element attached to the anchor post configured to resist movement of the anchor post. In some embodiments, the anchor post is configured for installation into the ground with a bottom-driver.

In another aspect, provided herein is an anchor post comprising: (a) a shaft; and (b) at least one stabilising element attached to the anchor post configured to resist or prevent movement of the anchor post, whereby the one or more stabilising element of the anchor post described herein is attached, for example longitudinally, to the shaft of the anchor post between about 1 millimeter and about 500 millimeters measured from the head of the anchor post to the top (or closest portion) of the stabilising element.

In another aspect, provided herein is an anchor post comprising: (a) a shaft; and (b) at least one stabilising element attached to the anchor post configured to resist or prevent movement of the anchor post, whereby the one or more stabilising element of the anchor post described herein is attached, for example longitudinally, to the shaft of the anchor post between about 1 millimeter and about 500 millimeters measured from the tail of the anchor post to the bottom (or closest portion) of the stabilising element.

In another aspect, provided herein is an anchor post comprising a shaft and at least two stabilising elements wherein at least one stabilising element is located near the head of the anchor post and at least one different stabilising element is located near the tail of the anchor post, wherein the anchor post is configured to provide improved stability or support to a load post when installed into the ground.

In a further aspect, provided herein is an anchor post comprising a shaft and at least one stabilising element attached to the anchor post that is of requisite shape and exposed surface area to resist or prevent movement of the anchor post.

In another aspect, provided herein is an anchor post comprising: (a) a shaft; (b) at least one stabilising element attached to the anchor post configured to resist movement of the anchor post; and (c) at least one alignment element that is configured to ensure the load post and the anchor post form between about a 175 degree angle and about a 180 degree angle relative to each other.

In one aspect, provided herein is an anchor post comprising: (a) a shaft; (b) at least one stabilising element attached to the anchor post configured to resist or prevent movement of the anchor post; and (c) at least one alignment element, whereby the alignment element is configured to compensate for imprecision during the installation of the anchor post or the alignment element is configured to compensate for a ground surface that is not perpendicular with the anchor post.

In another aspect, provided herein is an anchor post comprising: (a) a shaft; (b) at least one stabilising element attached to the anchor post configured to resist movement of the anchor post; and (c) at least one alignment element that is configured to connect to at least one load post without inserting the load post into the anchor post.

In another aspect, provided herein is an anchor post comprising: (a) a shaft; (b) at least one stabilising element attached to the anchor post configured to resist movement of the anchor post; and (c) at least one alignment element that is configured to connect to at least one load post without inserting a substantial portion of the load post into the anchor post.

In another aspect, provided herein does an anchor post comprising: (a) a shaft; and (b) at least one stabilising element attached to the anchor post configured to resist movement of the anchor post; wherein the anchor post does not contain an internal socket for insertion of a load post.

In another aspect, provided herein is an anchor post comprising: (a) a shaft; (b) at least one stabilising element attached to the anchor post configured to resist movement of the anchor post; and (c) an alignment element that is configured to attach to a load post, wherein the load post is optionally connected to a lateral support.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 1:
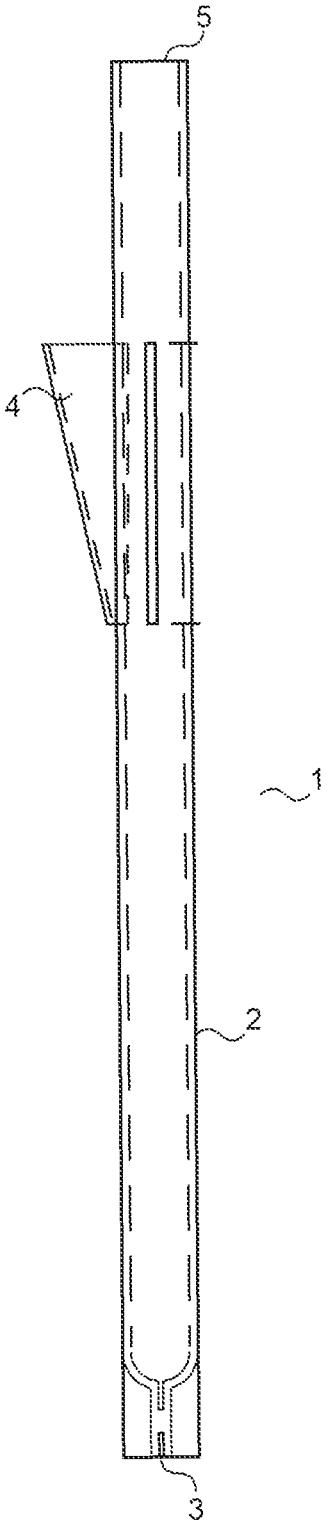
FIG. 1 is a cross sectional view of one embodiment of an anchor post as described herein.

This application claims the right of priority under 35 USC §119 (a)-(d) of European Patent Application No. 08251833.3, filed May 27, 2008, which is hereby incorporated by reference in its entirety and which claims the benefit of Great Britain Patent Application No. 0711903.5, filed on Jun. 20, 2007, which is hereby incorporated by reference in its entirety.

As used herein, the words "comprise" and "contain" and variations of them mean "including but not limited to" are not intended to (and do not) exclude other additives, components, steps, integers, values, and the like.

As used herein, the singular encompasses the plural unless the context otherwise requires. In particular, where the indefinite article is used, the specification is to be understood as contemplating plurality as well as singularity, unless the context requires otherwise.

Features, characteristics, groups, and the like described in conjunction with a particular aspect, embodiment or example of the subject matter described herein are to be understood to be applicable to any other aspect, embodiment or example described herein unless incompatible therewith. All of the features and embodiments disclosed in this specification (including any accompanying claims, abstract and drawings), and/or all of the steps of any method or process so disclosed, may be combined in any combination, except combinations where at least some of such features and/or steps are mutually exclusive. The subject matter as described herein is not restricted to the details of any foregoing embodiments.

The subject matter disclosed herein relates to an anchor post, such as that used for anchoring objects to the ground or other suitable surface.

Prior to the inventive date of the subject matter described herein, existing anchor posts have been heavy duty structures which must be manually dug into the ground requiring a costly and time consuming process. For example, existing anchor posts can only be inserted into the ground by digging a pit into which the anchor posts are installed. Concrete is then poured into the pit which sets to hold and provide stability to the anchor post in position. It has been reported that existing anchor posts require in the region of 8 hours to install 5 traditional anchor posts into the ground.

Specific examples of traditional anchor posts include screw piles, including telescopic screw piles, such as that disclosed in British Patent Application GB 2397327. A screw pile is formed from at least a first and a second length of tubing arranged in a telescopic relationship. The first length comprises a "screwpile" which carries on its lower region helical flights to enable ground penetration by rotation of the screwpile. The second length of tubing is substantially above ground to support the mast or cable supports and is engageable with the first length of tubing. Commonly, the screwpile is then secured using an Angel Pile™ such as that marketed by Screwfast Foundations Limited. The screw pile/Angel Pile™ system can only be secured and stabilized with an additional step after a standard screwpile has been driven into the ground.

More recently, ground anchors with internal sockets for supporting replaceable guide posts have been developed, for example, those described in PCT Publication No. WO 2005/010300. However, existing systems with internal sockets require that the guide post be inserted into a socket of the ground anchor, thereby limiting the types of guide posts that can be used, and also limiting the types of applications the system can be used for. For example, in many situations, obstructions encountered during installation of the anchor post into the ground will cause the anchor post to be inserted into the ground at an improper angle, or an angle that is less than desirable. Or, in other situations, the anchor post will be installed into an enbankment or other inclination. Thus, in these and other situations, any load post that is connected to an anchor post through insertion of the load post into a socket of the anchor post will be erected at an improper angle. The internal socket of existing anchor posts will prevent any re-alignment of the load post.

In addition, existing systems require a retaining means for effecting release of a load post from the internal socket of the ground anchor in certain situations, e.g. when a road sign is being repaired after being struck by an automobile. Existing systems also require a retaining means and latch in combination with a socket. These existing systems exhibit a lack of any permanency of the load post when connected to an anchor post and the inability to use heavy-duty and versatile manufacturing materials, for example recycled steel construction and other materials as contemplated with the instant anchor post and disclosed herein. Existing systems also exhibit an inability to permanently install these types of systems in an efficient manner and a lack of any capacity for these types of systems to withstand significant forces, energies and weights.

Provided herein are devices, methods and systems for installing a robust, efficient, and practical anchor post that addresses the shortcomings of prior methods, devices, and systems. Also provided herein is a completely integrated and enhanced protocol by which appropriate personnel can efficiently install an anchor post and thereby provide support and stability to a load post for various construction applications.

Anchor Posts

Anchor Posts that are Resistant to Movement

A feature of certain embodiments of the anchor posts described herein is the resistance of the anchor post to movement when the anchor post is installed into the ground.

In some embodiments, provided herein is an anchor post comprising: (a) a shaft; (b) at least one stabilising element (including but not limited to one, two, three, four, five, six, or more stabilising elements) attached to the anchor post configured to resist movement of the anchor post; and (c) at least one alignment element. In some embodiments, the alignment element is configured to connect to at least one load post without inserting a substantial portion of the load post into the anchor post.

In some embodiments, the anchor posts described herein comprise a shaft to which is fixed or attached at least one stabilising element (including but not limited to one, two, three, four, five, six, or more stabilising elements) wherein the anchor post is configured to resist rotational movement. In further or additional embodiments, the anchor posts described herein comprise at least one stabilising element providing a resistance to lateral movement. In still further embodiments, the anchor posts described herein comprising one or more stabilising element attached to the anchor post, whereby the anchor posts are resistant to rotation about its own axis (or an axis parallel to the axis of the anchor post). In still further embodiments, the anchor posts described herein comprising one or more stabilising element are resistant to rotation about an axis perpendicular to the axis of the anchor post. Thus, in some embodiments, the anchor posts described herein are resistant to movement, whereby the resistance is to movement about an axis parallel to the anchor post or to an axis perpendicular to the anchor post, or a combination thereof. In still further embodiments, one or more stabilising element is configured to provide resistance to lateral loads in the sub-soil strata close the ground surface.

In still further or additional embodiments, the anchor posts described herein comprising one or more stabilising element (including but not limited to one, two, three, four, five, six, or more stabilising elements) is configured to resist movement whereby the resistance is to the overturning of the anchor post. In yet further embodiments, the anchor posts described herein comprising one or more stabilising element is resistant to any detectable movement.

Anchor Posts with an Enhanced Drive-Rate

Another feature of certain embodiments of the anchor posts described herein is the efficient installation of the anchor post into the ground with an enhanced drive-rate. A drive-rate is calculated using the following formula:

$$\text{Drive-Rate}=[\text{length of anchor post (in millimeters)}]/[\text{amount of time (in seconds)}].$$

The amount of time (in seconds) is calculated from measuring the time from the moment the requisite level of force (e.g. 3 kN) is applied to the head of the anchor post (e.g. with a percussion bottom-driver) to the moment the head of the anchor post reaches the surface level of the ground, without any interruption.

In some embodiments, provided herein is an anchor post comprising a shaft and at least one stabilising element (including but not limited to one, two, three, four, five, six, or more stabilising elements) attached to the anchor post, wherein the head of the anchor post is configured for installation into displaceable ground material at a drive-rate of at least about 5 millimeters of anchor post per second when about 3 kN of force is applied to the head of the anchor post. In further embodiments, provided is an anchor post comprising a shaft and at least one stabilising element (including but not limited to one, two, three, four, five, six, or more stabilising elements) attached to the anchor post, wherein the anchor post is configured for installation into displaceable ground material when about 3 kN of force is applied to the head of the anchor post at a drive-rate of at least about 5 millimeters of anchor post per second, at least about 6 millimeters of anchor post per second, at least about 7 millimeters of anchor post per second, at least about 8 millimeters of anchor post per second, at least about 9 millimeters of anchor post per second, at least about 10 millimeters of anchor post per second, at least about 11 millimeters of anchor post per second, at least about 12 millimeters of anchor post per second, at least about 13 millimeters of anchor post per second, at least about 14 millimeters of anchor post per second, at least about 15 millimeters of anchor post per second, at least about 16 millimeters of anchor post per second, at least about 17 millimeters of anchor post per second, at least about 18 millimeters of anchor post per second, at least about 19 millimeters of anchor post per second, at least about 20 millimeters of anchor post per second, at least about 21 millimeters of anchor post per second, at least about 22 millimeters of anchor post per second, at least about 23 millimeters of anchor post per second, at least about 24 millimeters of anchor post per second, at least about 25 millimeters of anchor post per second, at least about 28 millimeters of anchor post per second, at least about 30 millimeters of anchor post per second, at least about 32 millimeters of anchor post per second, at least about 35 millimeters of anchor post per second, at least about 40 millimeters of anchor post per second, at least about 45 millimeters of anchor post per second, or at least about 50 millimeters of anchor post per second.

In further embodiments, the anchor post comprises a shaft and at least one stabilising element (including but not limited to one, two, three, four, five, six, or more stabilising elements) attached to the anchor post, wherein the head of the anchor post is configured for installation into a displaceable ground material to surface level at a drive-rate of between at least about 5 millimeters of anchor post per second and at least about 50 millimeters of anchor post per second, or any numeral rate within the recited range as described herein, when about 3 kN of force is applied to the head of the anchor post, wherein the displaceable ground material is chalk, gravel, limestone, sands, silts, clays, marl, ballast, soils, fractured sandstone, peat, ash, alluvium, glacial till, miscellaneous fill, or other displaceable ground material, or a combination thereof.

Another feature of certain embodiments of the subject matter described herein is an anchor post of sufficient length to provide adequate stabilization to a load post in various ground conditions, but manufactured at a short enough length to enable personnel to bottom-drive the anchor post into the ground, for example with a hand-held percussion driver.

In some embodiments, provided herein is an anchor post comprising a shaft and at least one stabilising element (including but not limited to one, two, three, four, five, six, or more stabilising elements) attached to the anchor post, wherein the anchor post is at least about 50 millimeters in length, measured from head tip to tail tip. In further or additional embodiments, provided is an anchor post comprising a shaft and at least one stabilising element (including but not limited to one, two, three, four, five, six, or more stabilising elements) attached to the anchor post, wherein the length of the anchor post is within the range of about 50 millimeters in length to about 2500 millimeters in length. In further embodiments, provided herein is an anchor post comprising a shaft and at least one stabilising element attached to the anchor post, wherein the anchor post, when measured from head tip to tail tip, is within the range of about 75 millimeters in length to about 2475 millimeters in length, about 100 millimeters in length to about 2450 millimeters in length, about 150 millimeters in length to about 2425 millimeters in length, about 250 millimeters in length to about 2400 millimeters in length, about 300 millimeters in length to about 2375 millimeters in length, about 350 millimeters in length to about 2325 millimeters in length, about 400 millimeters in length to about 2300 millimeters in length, about 450 millimeters in length to about 2475 millimeters in length, about 500 millimeters in length to about 2450 millimeters in length, about 550 millimeters in length to about 2400 millimeters in length, about 600 millimeters in length to about 2375 millimeters in length, about 650 millimeters in length to about 2350 millimeters in length, about 700 millimeters in length to about 2300 millimeters in length, about 750 millimeters in length to about 2350 millimeters in length, about 800 millimeters in length to about 2250 millimeters in length, about 810 millimeters in length to about 2200 millimeters in length, about 820 millimeters in length to about 2150 millimeters in length, about 830 millimeters in length to about 2125 millimeters in length, about 840 millimeters in length to about 2100 millimeters in length, about 850 millimeters in length to about 2050 millimeters in length, about 900 millimeters in length to about 2000 millimeters in length, about 950 millimeters in length to about 2050 millimeters in length, about 975 millimeters in length to about 2100 millimeters in length, about 1000 millimeters in length to about 2050 millimeters in length, about 1025 millimeters in length to about 2000 millimeters in length, about 1050 millimeters in length to about 1950 millimeters in length, about 1075 millimeters in length to about 1900 millimeters in length, about 1100 millimeters in length to about 1850 millimeters in length, about 1050 millimeters in length to about 1800 millimeters in length, about 1000 millimeters in length to about 1750 millimeters in length, about 1010 millimeters in length to about 1700 millimeters in length, about 1020 millimeters in length to about 1650 millimeters in length, about 1030 millimeters in length to about 1625 millimeters in length, about 1040 millimeters in length to about 1600 millimeters in length, about 1050 millimeters in length to about 1575 millimeters in length, about 1060 millimeters in length to about 1550 millimeters in length, about 1070 millimeters in length to about 1525 millimeters in length, about 1080 millimeters in length to about 1500 millimeters in length, about 1090 millimeters in length to about 1475 millimeters in length, about 1100 millimeters in length to about 1450 millimeters in length, about 1110 millimeters in length to about 1625 millimeters in length, about 1120 millimeters in length to about 1425 millimeters in length, about 1130 millimeters in length to about 1400 millimeters in length, about 1140 millimeters in length to about 1375 millimeters in length, about 1150 millimeters in length to about 1350 millimeters in length, about 1160 millimeters in length to about 1350 millimeters in length, about 1170 millimeters in length to about 1325 millimeters in length, about 1175 millimeters in length to about 1300 millimeters in length, about 1180 millimeters in length to about 1375 millimeters in length, about 1182 millimeters in length to about 1350 millimeters in length, about 1185 millimeters in length to about 1325 millimeters in length, about 1187 millimeters in length to about 1300 millimeters in length, about 1190 millimeters in length to about 1275 millimeters in length, about 1192 millimeters in length to about 1250 millimeters in length, about 1195 millimeters in length to about 1225 millimeters in length, or about 1200 millimeters in length.

In several embodiments, the length of the anchor post will depend on its intended use. For example, in one embodiment, the anchor post is installed into an enbankment or into soft ground material. In these and other situations, a longer anchor post, generally, but not limited to, an anchor post of a length of at least about 1200 millimeters to about 2500 millimeters, or any numerical millimeter integar within the recited range, is desirable. In other situations, the anchor post is installed into a hard ground material, or area with a limited amount of displaceable material in the ground sediment. In these and other situations, a shorter anchor post, generally, but not limited to, an anchor post of a length of about 50 millimeters to about 1200 millimeters is desirable. By way of one non-limiting example, FIG. 1 depicts an anchor post 1 that is of length 1200 millimeters or 1500 millimeters.

Versatile Manufacturing Materials

Another feature of certain embodiments of the subject matter described herein is an anchor post manufactured out of a versatile material. For example, in some embodiments, the anchor post comprises a shaft and at least one stabilising element, wherein the anchor post is manufactured out of versatile material. In some embodiments, the anchor posts described herein comprise a shaft and at least one stabilising element, wherein the anchor post is manufactured out of a versatile material and the versatile material is steel, for example, recycled steel, stainless steel, cast iron, graphite iron, glass reinforced fiber, extruded resin plastics, pull-truded plastic, molded plastic, or other suitable material(s), or a combination thereof.

Anchor Post Shafts

Another feature of certain embodiments of the subject matter described herein is the efficient installation of the anchor post into the ground using a drive rod that is inserted into a shaft of the anchor post.

In some embodiments, provided herein is an anchor post comprising: (a) a shaft that is configured to receive a drive rod; and (b) at least one stabilising element (including, but not limited to one, two, three, four, five, six, or more stabilising elements) attached to the anchor post configured to resist movement of the anchor post. In further embodiments, the anchor post is configured to receive a drive rod wherein the anchor post is configured for installation into the ground with a bottom-driver. In some embodiments, the anchor post comprises a shaft and the shaft is at least 5 millimeters in diameter.

In further or additional embodiments, the anchor post comprises a shaft and the shaft is between about 5 millimeters in diameter and about 500 millimeters in diameter. In some embodiments, the anchor post comprises a shaft and the shaft is about 5 millimeters in diameter, about 6 millimeters diameter, about 7 millimeters in diameter, about 8 millimeters in diameter, about 9 millimeters in diameter, about 10 millimeters in diameter, about 11 millimeters in diameter, about 12 millimeters in diameter, about 13 millimeters in diameter, about 14 millimeters in diameter, about 15 millimeters in diameter, about 16 millimeters in diameter, about 17 millimeters in diameter, about 18 millimeters in diameter, about 19 millimeters in diameter, about 20 millimeters in diameter, about 21 millimeters in diameter, about 22 millimeters in diameter, about 27 millimeters in diameter, about 28 millimeters in diameter, about 29 millimeters in diameter, about 30 millimeters in diameter, about 31 millimeters in diameter, about 32 millimeters in diameter, about 33 millimeters in diameter, about 34 millimeters in diameter, about 35 millimeters in diameter, about 36 millimeters in diameter, about 37 millimeters in diameter, about 38 millimeters in diameter, about 39 millimeters in diameter, about 40 millimeters in diameter, about 41 millimeters in diameter, about 42 millimeters in diameter, about 43 millimeters in diameter, about 44 millimeters in diameter, about 45 millimeters in diameter, about 46 millimeters in diameter, about 47 millimeters in diameter, about 48 millimeters in diameter, about 49 millimeters in diameter, about 50 millimeters in diameter, about 51 millimeters in diameter, about 52 millimeters in diameter, about 53 millimeters in diameter, about 54 millimeters in diameter, about 55 millimeters in diameter, about 56 millimeters in diameter, about 57 millimeters in diameter, about 58 millimeters in diameter, about 59 millimeters in diameter, about 60 millimeters in diameter, about 60 millimeters in diameter, about 60 millimeters in diameter, about 60 millimeters in diameter, about 60 millimeters in diameter, about 60 millimeters in diameter, about 61 millimeters in diameter, about 62 millimeters in diameter, about 63 millimeters in diameter, about 64 millimeters in diameter, about 65 millimeters in diameter, about 66 millimeters in diameter, about 67 millimeters in diameter, about 68 millimeters in diameter, about 69 millimeters in diameter, about 70 millimeters in diameter, about 71 millimeters in diameter, about 72 millimeters in diameter, about 73 millimeters in diameter, about 74 millimeters in diameter, about 75 millimeters in diameter, about 80 millimeters in diameter, about 85 millimeters in diameter, about 90 millimeters in diameter, about 95 millimeters in diameter, about 100 millimeters in diameter, about 110 millimeters in diameter, about 120 millimeters in diameter, about 140 millimeters in diameter, about 160 millimeters in diameter, about 180 millimeters in diameter, about 200 millimeters in diameter, about 230 millimeters in diameter, about 260 millimeters in diameter, about 300 millimeters in diameter, about 340 millimeters in diameter, about 380 millimeters in diameter, about 400 millimeters in diameter, about 450 millimeters in diameter, or about 500 millimeters in diameter.

In some embodiments, the shaft of the anchor posts described herein further comprises a crimped end at or near the tail of the anchor post. In other embodiments, the shaft of the anchor post does not comprise a crimped end. In further embodiments, the shaft of the anchor post does not comprise a crimped end but a straight end or an end of a different configuration suitable for the embodiments of the anchor post.

The anchor posts described herein comprising a crimped end provide improved balance of the anchor post during insertion into the ground. The crimped end also ensures that the anchor post remains perpendicular to the ground during installation of the anchor post into the ground.

In some embodiments, the crimped end forms a cross-configuration. The anchor posts described herein comprising a cross-configuration are configured to provide control and direction during installation into the ground, thereby ensuring the anchor post enters the ground and is implanted into the ground in a desired manner, e.g. a perpendicular manner.

Figure 2:
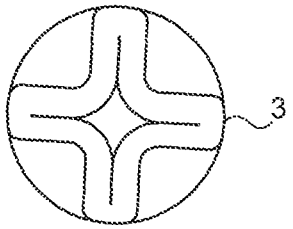
FIG. 2 is a view from below of one embodiment of the tail end of an anchor post as described herein.

Referring to one non-limiting embodiment of the presently disclosed subject matter, FIG. 1 depicts an anchor post 1 which comprises a thin walled steel tube 2 which is shaped at a first end and pinched to form a cross configuration 3, as further depicted in FIG. 2.

In some embodiments, the anchor post comprises a shaft and the shaft, e.g. about 40 to about 45 millimeters in diameter, is configured to receive a drive rod, wherein the drive rod is at least 5 millimeters in diameter. In further or additional embodiments, the anchor post comprises a shaft and the shaft is configured to receive a drive rod that is between about 5 millimeters in diameter and about 500 millimeters in diameter. In some embodiments, the anchor post comprises a shaft and the shaft is configured to receive a drive rod that is about 5 millimeters in diameter, about 6 millimeters diameter, about 7 millimeters in diameter, about 8 millimeters in diameter, about 9 millimeters in diameter, about 10 millimeters in diameter, about 11 millimeters in diameter, about 12 millimeters in diameter, about 13 millimeters in diameter, about 14 millimeters in diameter, about 15 millimeters in diameter, about 16 millimeters in diameter, about 17 millimeters in diameter, about 18 millimeters in diameter, about 19 millimeters in diameter, about 20 millimeters in diameter, about 21 millimeters in diameter, about 22 millimeters in diameter, about 27 millimeters in diameter, about 28 millimeters in diameter, about 29 millimeters in diameter, about 30 millimeters in diameter, about 31 millimeters in diameter, about 32 millimeters in diameter, about 33 millimeters in diameter, about 34 millimeters in diameter, about 35 millimeters in diameter, about 36 millimeters in diameter, about 37 millimeters in diameter, about 38 millimeters in diameter, about 39 millimeters in diameter, about 40 millimeters in diameter, about 41 millimeters in diameter, about 42 millimeters in diameter, about 43 millimeters in diameter, about 44 millimeters in diameter, about 45 millimeters in diameter, about 46 millimeters in diameter, about 47 millimeters in diameter, about 48 millimeters in diameter, about 49 millimeters in diameter, about 50 millimeters in diameter, about 51 millimeters in diameter, about 52 millimeters in diameter, about 53 millimeters in diameter, about 54 millimeters in diameter, about 55 millimeters in diameter, about 56 millimeters in diameter, about 57 millimeters in diameter, about 58 millimeters in diameter, about 59 millimeters in diameter, about 60 millimeters in diameter, about 60 millimeters in diameter, about 60 millimeters in diameter, about 60 millimeters in diameter, about 60 millimeters in diameter, about 60 millimeters in diameter, about 61 millimeters in diameter, about 62 millimeters in diameter, about 63 millimeters in diameter, about 64 millimeters in diameter, about 65 millimeters in diameter, about 66 millimeters in diameter, about 67 millimeters in diameter, about 68 millimeters in diameter, about 69 millimeters in diameter, about 70 millimeters in diameter, about 71 millimeters in diameter, about 72 millimeters in diameter, about 73 millimeters in diameter, about 74 millimeters in diameter, about 75 millimeters in diameter, about 80 millimeters in diameter, about 85 millimeters in diameter, about 90 millimeters in diameter, about 95 millimeters in diameter, about 100 millimeters in diameter, about 110 millimeters in diameter, about 120 millimeters in diameter, about 140 millimeters in diameter, about 160 millimeters in diameter, about 180 millimeters in diameter, about 200 millimeters in diameter, about 230 millimeters in diameter, about 260 millimeters in diameter, about 300 millimeters in diameter, about 340 millimeters in diameter, about 380 millimeters in diameter, about 400 millimeters in diameter, about 450 millimeters in diameter, or about 500 millimeters in diameter.

In some embodiments of the anchor posts described herein, the anchor post further comprises a shaft and the shaft is configured to receive a drive rod to facilitate bottom-driving with a bottom driver. In further or additional embodiments, the anchor post is percussion-driven into the ground, thereby providing for quicker installation than with use of heavy duty machinery. In further or additional embodiments, the bottom driver is an anti-vibrational hammer.

Stabilising Elements

Resistance to, and Prevention of, Movement

A feature of certain embodiments of the anchor posts described herein is the resistance to, or prevention of, movement of the anchor post when installed into the ground. In some embodiments, anchor posts utilizing one or more stabilising element provide greater stability to withstand external forces acting upon the anchor post when installed into the ground. For example, in further embodiments, an anchor post configured with at least one stabilising element provides greater stability to withstand vortex created by automotive vehicles traveling at high speeds, e.g. a train, when anchor posts are used in applications adjacent to automotive vehicles, e.g. rail side purposes. In further or additional embodiments, an anchor post configured with at least one stabilising element provides stability in extreme weather conditions, including snow, rain sleet, tornados, hurricanes, fire, and the like.

In some embodiments, an anchor post configured with at least two stabilising elements provides greater stability when compared to an anchor post configured with zero stabilising elements or one stabilising element. In further embodiments, an anchor post utilizing three stabilising elements provides greater stability when compared to an anchor post utilizing zero stabilising elements, one stabilising element or two stabilising elements.

In some embodiments, provided herein is an anchor post comprising: (a) a shaft; and (b) at least one stabilising element (including, but not limited to, one, two, three, four, five, six, or more stabilising elements) attached to the anchor post configured to resist or prevent movement of the anchor post. In further or additional embodiments, one or more stabilising element (including one, two, three, four, five, six, or more stabilising elements) is attached to the shaft of the anchor post. In further embodiments, the anchor posts described herein contain at least two stabilising elements. In further embodiments, the anchor posts described herein contain at least three stabilising elements. In further embodiments, the anchor posts described herein contain at least four stabilising elements. In still further embodiments, the anchor posts described herein contain at least five stabilising elements. In further or additional embodiments, the anchor posts described herein contain at least six stabilising elements. In further or additional embodiments, the anchor posts described herein contain more than six stabilising elements.

Stabilising Element(s) Near the "Head"

Another feature of certain embodiments of the subject matter described herein is an anchor post comprising a shaft and at least one stabilising element (including, but not limited to, one, two, three, four, five, six, or more stabilising elements) wherein the stabilising element is located longitudinally along the shaft in relation to the head of the anchor post to improve the stability of the anchor post when installed into the ground. In some embodiments, one or more stabilising element located near the head of the anchor post will improve stability of the anchor post when installed into the ground.

In some embodiments, the one or more stabilising element (including, but not limited to, one, two, three, four, five, six, or more stabilising elements) of the anchor post described herein is attached, for example longitudinally, to the shaft of the anchor post between about 1 millimeter and about 500 millimeters measured from the head of the anchor post to the top (or closest portion) of the stabilising element. In describing the attachment of the one or more stabilising element as between two lengths, any portion of the stabilising element is between the recited lengths, but the entire portion of the stabilising element need not be. For example, in some embodiments as described herein, the one or more stabilising element is attached between about 1 millimeter and about 500 millimeters measured from the head of the anchor post, and it is understood that any portion of the one or more stabilising element is located between 1 millimeter and about 500 millimeters measured from the head of the anchor post and the entire length of the stabilising element may be located between 1 millimeter and about 500 millimeters measured from the head but it need not be.

In further embodiments, the one or more stabilising element (including one, two, three, four, five, six, or more stabilising elements) of the anchor post described herein is attached to the shaft of the anchor post between about 2 millimeters and about 499 millimeters measured from the head of the anchor post, between about 3 millimeters and about 498 millimeters measured from the head of the anchor post, between about 4 millimeters and about 497 millimeters measured from the head of the anchor post, between about 5 millimeters and about 496 millimeters measured from the head of the anchor post, between about 6 millimeters and about 495 millimeters measured from the head of the anchor post, between about 7 millimeters and about 494 millimeters measured from the head of the anchor post, between about 8 millimeters and about 493 millimeters measured from the head of the anchor post, between about 9 millimeters and about 492 millimeters measured from the head of the anchor post, between about 10 millimeters and about 491 millimeters measured from the head of the anchor post, between about 11 millimeters and about 490 millimeters measured from the head of the anchor post, between about 12 millimeters and about 489 millimeters measured from the head of the anchor post, between about 13 millimeters and about 488 millimeters measured from the head of the anchor post, between about 14 millimeters and about 487 millimeters measured from the head of the anchor post, between about 15 millimeters and about 486 millimeters measured from the head of the anchor post, between about 16 millimeters and about 485 millimeters measured from the head of the anchor post, between about 20 millimeters and about 450 millimeters measured from the head of the anchor post, between about 25 millimeters and about 430 millimeters measured from the head of the anchor post, between about 30 millimeters and about 420 millimeters measured from the head of the anchor post, between about 35 millimeters and about 410 millimeters measured from the head of the anchor post, between about 40 millimeters and about 400 millimeters measured from the head of the anchor post, between about 45 millimeters and about 390 millimeters measured from the head of the anchor post, between about 50 millimeters and about 380 millimeters measured from the head of the anchor post, between about 55 millimeters and about 360 millimeters measured from the head of the anchor post, between about 60 millimeters and about 350 millimeters measured from the head of the anchor post, between about 65 millimeters and about 340 millimeters measured from the head of the anchor post, between about 70 millimeters and about 330 millimeters measured from the head of the anchor post, between about 71 millimeters and about 300 millimeters measured from the head of the anchor post, between about 72 millimeters and about 290 millimeters measured from the head of the anchor post, between about 73 millimeters and about 280 millimeters measured from the head of the anchor post, between about 74 millimeters and about 270 millimeters measured from the head of the anchor post, between about 75 millimeters and about 260 millimeters measured from the head of the anchor post, between about 76 millimeters and about 250 millimeters measured from the head of the anchor post, between about 77 millimeters and about 240 millimeters measured from the head of the anchor post, between about 78 millimeters and about 230 millimeters measured from the head of the anchor post, between about 79 millimeters and about 220 millimeters measured from the head of the anchor post, between about 80 millimeters and about 210 millimeters measured from the head of the anchor post, between about 81 millimeters and about 200 millimeters measured from the head of the anchor post, between about 82 millimeters and about 210 millimeters measured from the head of the anchor post, between about 83 millimeters and about 200 millimeters measured from the head of the anchor post, between about 84 millimeters and about 190 millimeters measured from the head of the anchor post, between about 85 millimeters and about 180 millimeters measured from the head of the anchor post, between about 86 millimeters and about 170 millimeters measured from the head of the anchor post, between about 87 millimeters and about 160 millimeters measured from the head of the anchor post, between about 88 millimeters and about 150 millimeters measured from the head of the anchor post, between about 89 millimeters and about 145 millimeters measured from the head of the anchor post, between about 90 millimeters and about 142 millimeters measured from the head of the anchor post, between about 91 millimeters and about 140 millimeters measured from the head of the anchor post, between about 92 millimeters and about 135 millimeters measured from the head of the anchor post, between about 93 millimeters and about 130 millimeters measured from the head of the anchor post, between about 94 millimeters and about 125 millimeters measured from the head of the anchor post, between about 95 millimeters and about 120 millimeters measured from the head of the anchor post, between about 96 millimeters and about 115 millimeters measured from the head of the anchor post, between about 97 millimeters and about 110 millimeters measured from the head of the anchor post, between about 98 millimeters and about 108 millimeters measured from the head of the anchor post, between about 99 millimeters and about 105 millimeters measured from the head of the anchor post, or about 100 millimeters measured from the head of the anchor post, whereby the distance is measured from the head of the anchor post to the top (or closest portion) of the stabilising element.

Figure 11:
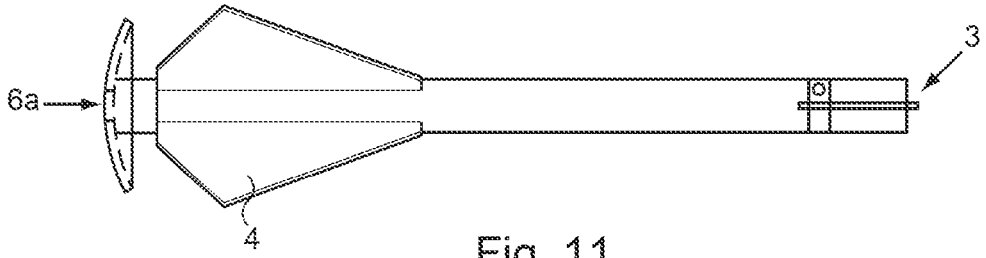
FIG. 11 is a cross sectional view of one or more embodiments of an anchor post as described herein.
Figure 12:
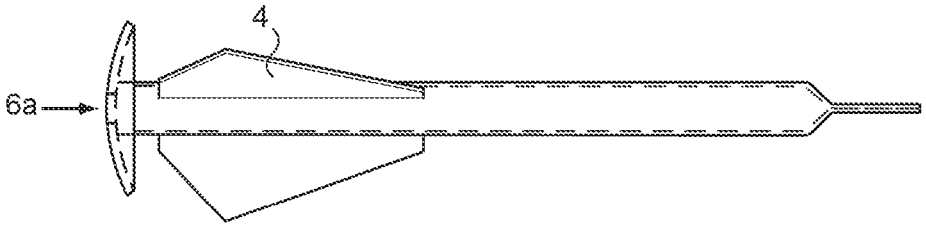
FIG. 12 is a cross sectional view of one or more embodiment of an anchor post as described herein.

Referring to one non-limiting embodiment of the subject matter described herein, depicted in FIGS. 11 and 12 is an anchor post of about 1200 millimeters comprising three stabilising elements 4 (only two for each anchor post is depicted). Each stabilising element is formed into an about an 8 millimeter thick plate comprised of recycled steel. FIGS. 11 and 12 further depict a "toe" plate 3 that is about 5 millimeters thick and is composed of recycled steel. The toe plate 3 is about 135 millimeters in length. In FIG. 11, the toe plate 3 forms a crimped end. In FIG. 12, the toe plate 3 further comprises a drainage hole to assist with galvanizing. Also depicted in FIGS. 11 and 12 is an alignment plate **6*a*** of about 200 millimeters in diameter and about 10 millimeters in thickness. In some embodiments, the alignment plate is a hemispherical domed plate that is of convex shape. In further embodiments, the alignment element is configured to attach to a load post.

Stabilising Element(s) Near the "Tail"

Another feature of certain embodiments of the subject matter described herein is an anchor post comprising a shaft and at least one stabilising element (including, but not limited to, one, two, three, four, five, six, or more stabilising elements) wherein the stabilising element is located longitudinally along the shaft in relation to the tail of the anchor post to improve the stability of the anchor post when installed into the ground. In some embodiments, one or more stabilising element located near the tail of the anchor post will improve stability of the anchor post when installed into the ground.

In further embodiments, the one or more stabilising element (including, but not limited to, one, two, three, four, five, six, or more stabilising elements) of the anchor post described herein is attached, for example longitudinally, to the shaft of the anchor post between about 1 millimeter and about 500 millimeters measured from the tail of the anchor post to the bottom (or closest portion) of the stabilising element. In describing the attachment of the one or more stabilising element as between two lengths, any portion of the stabilising element is between the recited lengths, but the entire portion of the stabilising element need not be. For example, in some embodiments as described herein, the one or more stabilising element is attached between about 1 millimeter and about 500 millimeters measured from the tail of the anchor post, and it is understood that any portion of the one or more stabilising element is located between 1 millimeter and about 500 millimeters measured from the tail of the anchor post and the entire length of the stabilising element may be located between 1 millimeter and about 500 millimeters measured from the tail but it need not be.

In further embodiments, the one or more stabilising element (including one, two, three, four, five, six, or more stabilising elements) of the anchor post described herein is attached to the shaft of the anchor post between about 2 millimeters and about 499 millimeters measured from the tail of the anchor post, between about 3 millimeters and about 498 millimeters measured from the tail of the anchor post, between about 4 millimeters and about 497 millimeters measured from the tail of the anchor post, between about 5 millimeters and about 496 millimeters measured from the tail of the anchor post, between about 6 millimeters and about 495 millimeters measured from the tail of the anchor post, between about 7 millimeters and about 494 millimeters measured from the tail of the anchor post, between about 8 millimeters and about 493 millimeters measured from the tail of the anchor post, between about 9 millimeters and about 492 millimeters measured from the tail of the anchor post, between about 10 millimeters and about 491 millimeters measured from the tail of the anchor post, between about 11 millimeters and about 490 millimeters measured from the tail of the anchor post, between about 12 millimeters and about 489 millimeters measured from the tail of the anchor post, between about 13 millimeters and about 488 millimeters measured from the tail of the anchor post, between about 14 millimeters and about 487 millimeters measured from the tail of the anchor post, between about 15 millimeters and about 486 millimeters measured from the tail of the anchor post, between about 16 millimeters and about 485 millimeters measured from the tail of the anchor post, between about 20 millimeters and about 450 millimeters measured from the tail of the anchor post, between about 25 millimeters and about 430 millimeters measured from the tail of the anchor post, between about 30 millimeters and about 420 millimeters measured from the tail of the anchor post, between about 35 millimeters and about 410 millimeters measured from the tail of the anchor post, between about 40 millimeters and about 400 millimeters measured from the tail of the anchor post, between about 45 millimeters and about 390 millimeters measured from the tail of the anchor post, between about 50 millimeters and about 380 millimeters measured from the tail of the anchor post, between about 55 millimeters and about 360 millimeters measured from the tail of the anchor post, between about 60 millimeters and about 350 millimeters measured from the tail of the anchor post, between about 65 millimeters and about 340 millimeters measured from the tail of the anchor post, between about 70 millimeters and about 330 millimeters measured from the tail of the anchor post, between about 71 millimeters and about 300 millimeters measured from the tail of the anchor post, between about 72 millimeters and about 290 millimeters measured from the tail of the anchor post, between about 73 millimeters and about 280 millimeters measured from the tail of the anchor post, between about 74 millimeters and about 270 millimeters measured from the tail of the anchor post, between about 75 millimeters and about 260 millimeters measured from the tail of the anchor post, between about 76 millimeters and about 250 millimeters measured from the tail of the anchor post, between about 77 millimeters and about 240 millimeters measured from the tail of the anchor post, between about 78 millimeters and about 230 millimeters measured from the tail of the anchor post, between about 79 millimeters and about 220 millimeters measured from the tail of the anchor post, between about 80 millimeters and about 210 millimeters measured from the tail of the anchor post, between about 81 millimeters and about 200 millimeters measured from the tail of the anchor post, between about 82 millimeters and about 210 millimeters measured from the tail of the anchor post, between about 83 millimeters and about 200 millimeters measured from the tail of the anchor post, between about 84 millimeters and about 190 millimeters measured from the tail of the anchor post, between about 85 millimeters and about 180 millimeters measured from the tail of the anchor post, between about 86 millimeters and about 170 millimeters measured from the tail of the anchor post, between about 87 millimeters and about 160 millimeters measured from the tail of the anchor post, between about 88 millimeters and about 150 millimeters measured from the tail of the anchor post, between about 89 millimeters and about 145 millimeters measured from the tail of the anchor post, between about 90 millimeters and about 142 millimeters measured from the tail of the anchor post, between about 91 millimeters and about 140 millimeters measured from the tail of the anchor post, between about 92 millimeters and about 135 millimeters measured from the tail of the anchor post, between about 93 millimeters and about 130 millimeters measured from the tail of the anchor post, between about 94 millimeters and about 125 millimeters measured from the tail of the anchor post, between about 95 millimeters and about 120 millimeters measured from the tail of the anchor post, between about 96 millimeters and about 115 millimeters measured from the tail of the anchor post, between about 97 millimeters and about 110 millimeters measured from the tail of the anchor post, between about 98 millimeters and about 108 millimeters measured from the tail of the anchor post, between about 99 millimeters and about 105 millimeters measured from the tail of the anchor post, or about 100 millimeters measured from the tail of the anchor post, whereby the distance is measured from the tail of the anchor post to the bottom (or closest portion) of the stabilising element.

Stabilising Element(s) Near the "Head" and "Tail"

Another feature of certain embodiments of the subject matter described herein is an anchor post comprising a shaft and at least two stabilising elements (including, but not limited to, two, three, four, five, six, or more stabilising elements) wherein at least one stabilising element (including, but not limited to, one, two, three, four, five, six, or more stabilising elements) is located near the head of the anchor post and at least one different stabilising element (including, but not limited to, one, two, three, four, five, six, or more stabilising elements) is located near the tail of the anchor post, wherein the anchor post is configured for improved stability when installed into the ground. It has been determined that two or more stabilising elements, where at least one stabilising element is located near the head of the anchor post and at least one stabilising element is located near the tail of the anchor post will provide an improved stability of the anchor post when installed into the ground. In describing the attachment of the one or more stabilising element as between two lengths, any portion of the stabilising element is between the recited lengths, but the entire portion of the stabilising element need not be. For example, a stabilising element located between about 2 millimeters and 499 millimeters means that any portion of the stabilising element is located between that range, but the entire stabilising element need not be.

In further embodiments, at least one stabilising element (including one, two, three, four, five, six, or more stabilising elements) of the anchor post described herein is attached to the shaft of the anchor post between about 2 millimeters and about 499 millimeters measured from the head of the anchor post and at least one stabilising element (including one, two, three, four, five, six, or more stabilising elements) of the anchor post described herein is attached to the shaft of the anchor post between about 2 millimeters and about 499 millimeters measured from the tail of the anchor post, at least one stabilising element is attached between about 3 millimeters and about 498 millimeters measured from the head of the anchor post and at least one stabilising element is attached to the shaft of the anchor post between about 3 millimeters and about 498 millimeters measured from the tail of the anchor post, at least one stabilising element is attached between about 4 millimeters and about 497 millimeters measured from the head of the anchor post and at least one stabilising element is attached between about 4 millimeters and about 497 millimeters measured from the tail of the anchor post, at least one stabilising element located between about 5 millimeters and about 496 millimeters measured from the head of the anchor post and at least one stabilising element located between about 5 millimeters and about 496 millimeters measured from the tail of the anchor post, at least one stabilising element located between about 6 millimeters and about 495 millimeters measured from the head of the anchor post and at least one stabilising element located between about 6 millimeters and about 495 millimeters measured from the tail of the anchor post. At least one stabilising element located between about 7 millimeters and about 494 millimeters measured from the head of the anchor post and at least one stabilising element located between about 7 millimeters and about 494 millimeters measured from the head of the anchor post, at least one stabilising element located between about 8 millimeters and about 493 millimeters measured from the head of the anchor post and at least one stabilising element located between about 8 millimeters and about 493 millimeters measured from the tail of the anchor post, at least one stabilising element located between about 9 millimeters and about 492 millimeters measured from the head of the anchor post and at least one stabilising element located between about 9 millimeters and about 492 millimeters measured from the tail of the anchor post, at least one stabilising element located between about 10 millimeters and about 491 millimeters measured from the head of the anchor post and at least one stabilising element located between 10 millimeters and about 491 millimeters measured from the tail of the anchor post, at least one stabilising element located between about 11 millimeters and about 490 millimeters measured from the head of the anchor post and at least one stabilising element located between about 11 millimeters and about 490 millimeters measured from the tail of the anchor post.

In further or additional embodiments, at least one stabilising element (including one, two, three, four, five, six, or more stabilising elements) is attached to the shaft of the anchor post at a distance measured from the head, and at least one different stabilising element (including one, two, three, four, five, six, or more stabilising elements) is attached to the shaft of the anchor post at a distance measured from the tail, wherein the distance is between about 12 millimeters and about 489 millimeters measured, between about 13 millimeters and about 488 millimeters, between about 14 millimeters and about 487 millimeters, between about 15 millimeters and about 486 millimeters, between about 16 millimeters and about 485 millimeters, between about 20 millimeters and about 450 millimeters, between about 25 millimeters and about 430 millimeters, between about 30 millimeters and about 420 millimeters, between about 35 millimeters and about 410 millimeters, between about 40 millimeters and about 400 millimeters, between about 45 millimeters and about 390 millimeters, between about 50 millimeters and about 380 millimeters, between about 55 millimeters and about 360 millimeters, between about 60 millimeters and about 350 millimeters, between about 65 millimeters and about 340 millimeters, between about 70 millimeters and about 330 millimeters, between about 71 millimeters and about 300 millimeters, between about 72 millimeters and about 290 millimeters, between about 73 millimeters and about 280 millimeters, between about 74 millimeters and about 270 millimeters, between about 75 millimeters and about 260 millimeters, between about 76 millimeters and about 250 millimeters, between about 77 millimeters and about 240 millimeters, between about 78 millimeters and about 230 millimeters, between about 79 millimeters and about 220 millimeters, between about 80 millimeters and about 210 millimeters, between about 81 millimeters and about 200 millimeters, between about 82 millimeters and about 210 millimeters, between about 83 millimeters and about 200 millimeters, between about 84 millimeters and about 190 millimeters, between about 85 millimeters and about 180 millimeters, between about 86 millimeters and about 170 millimeters, between about 87 millimeters and about 160 millimeters, between about 88 millimeters and about 150 millimeters, between about 89 millimeters and about 145 millimeters, between about 90 millimeters and about 142 millimeters, between about 91 millimeters and about 140 millimeters, between about 92 millimeters and about 135 millimeters, between about 93 millimeters and about 130 millimeters, between about 94 millimeters and about 125 millimeters, between about 95 millimeters and about 120 millimeters, between about 96 millimeters and about 115 millimeters, between about 97 millimeters and about 110 millimeters, between about 98 millimeters and about 108 millimeters, between about 99 millimeters and about 105 millimeters, or about 100 millimeters. In these embodiments, the recited distance is the distance measured from the head of the anchor post to the at least one stabilising element and the recited distance is also the distance measured from the tail of the anchor post to the at least one different stabilising element.

Figure 9:
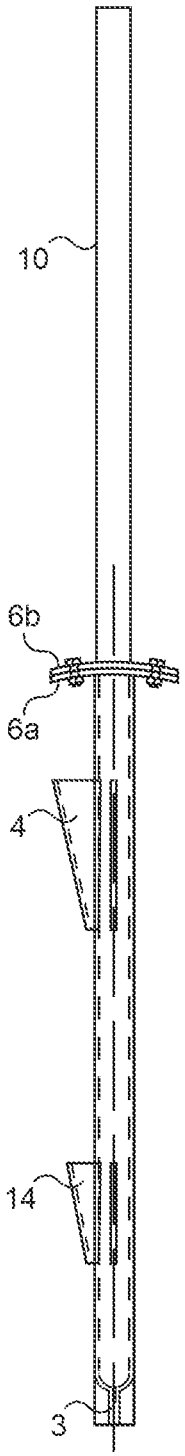
FIG. 9 is a perspective view of one embodiment of a anchor post as described herein, depicting an anchor post that is attached to a load post.
Figure 10:
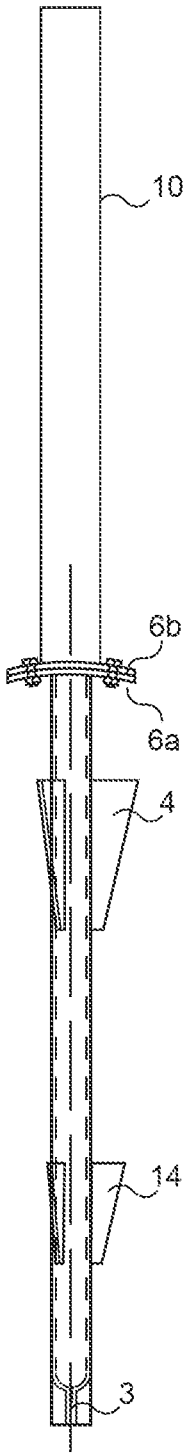
FIG. 10 is a further perspective view of one embodiment of an anchor post as described herein, depicting an anchor post attached to a load post.

Referring to one non-limiting embodiment of the subject matter described herein, depicted in FIGS. 9 and 10 is an anchor post 1 comprising a "toe" fin arrangement located near the tail of the anchor post. In further embodiments, three stabilising elements, e.g. "fin" elements 14, are welded to the surface of the tube closer to the "tail" than the "head" of the anchor post. In some embodiments, the anchor post comprises one or more stabilising elements, e.g. "fin" element 4, near the head of the anchor post. In further or additional embodiments, one or more stabilising element is attached near the "tail", e.g., a "toe" stabilising plate 14, of a shape to resist movement of the anchor post when inserted into the ground of the anchor post in the same manner as for the "head".

In further or additional embodiments, a stabilising element attached near the "tail" of the anchor post, e.g. a "toe" stabilising plate 14, is smaller than the "head" stabilising plates 4 located near the "head" of the anchor post. In other embodiments (not depicted in this Figure), the one or more stabilising element located near the tail of the anchor post is larger than the one or more stabilising element located near the "head" of the anchor post. In still further embodiments, the one or more stabilising element located near the "head" of the anchor post is about the same size as the one or more stabilising element located near the "tail" of the anchor post. As described herein, the dimensions and position of the stabilising plates, including stabilising elements attached near the "tail" of the anchor post and stabilising elements attached near the "head" of the anchor post will vary depending on the ground conditions—i.e. the substrate of the displaceable material located within the ground. In an alternative embodiment, the "head" fins 4 are at least 50 mm from the first end, or the "head" end of the anchor post 1 which opposes the "tail" end 5.

Shape and Surface Area of the Stabilising Element(s)

An additional feature of certain embodiments of the subject matter described herein is an anchor post comprising a shaft and at least one stabilising element (including, but not limited to, one, two, three, four, five, six, or more stabilising elements) attached to the anchor post that is of requisite shape and exposed surface area to resist movement of the anchor post. In some embodiments, an anchor post with at least one stabilising element shaped to resist extraction improves the stability of the anchor post.

For example, in some embodiments, the at least one stabilising element (including one, two, three, four, five, six, or more stabilising elements) is a geometric shape of a prism, for example a trapezoidal prism. In further or additional embodiments, the at least one stabilising element (including one, two, three, four, five, six, or more stabilising elements) is in the form a rectangular prism, a triangular prism, a cube, a pyramid, a hemisphere, or other three-dimensional geometric shape with sufficient surface area. In still further embodiments, the at least one stabilising element (including one, two, three, four, five, six, or more stabilising elements) is in the form of a three dimensional "fin" shape. In further or additional embodiments, the at least one stabilising element (including one, two, three, four, five, six, or more stabilising elements) is a barb.

In further or additional embodiments, the surface area of the at least one stabilising element (including one, two, three, four, five, six, or more stabilising elements) is at least about 2,000 $mm^2$. In further embodiments, the surface area of the at least one stabilising element (including one, two, three, four, five, six, or more stabilising elements) is at least about 3,000 $mm^2$, is at least about 4,000 $mm^2$, is at least about 5,000 $mm^2$, is at least about 6,000 $mm^2$, at least about 7,000 $mm^2$, at least about 8,000 $mm^2$, at least about 9,000 $mm^2$, at least about 10,000 $mm^2$, at least about 11,000 $mm^2$, at least about 12,000 $mm^2$, at least about 13,000 $mm^2$, at least about 14,000 $mm^2$, at least about 15,000 $mm^2$, at least about 16,000 $mm^2$, at least about 17,000 $mm^2$, at least about 18,000 $mm^2$, at least about 19,000 $mm^2$, at least about 20,000 $mm^2$, at least about 21,000 $mm^2$, at least about 22,000 $mm^2$, at least about 23,000 $mm^2$, at least about 24,000 $mm^2$, at least about 25,000 $mm^2$, at least about 26,000 $mm^2$, at least about 27,000 $mm^2$, at least about 28,000 $mm^2$, at least about 29,000 $mm^2$, at least about 30,000 $mm^2$, at least about 31,000 $mm^2$, at least about 32,000 $mm^2$, at least about 35,000 $mm^2$, at least about 40,000 $mm^2$, at least about 45,000 $mm^2$, at least about 50,000 $mm^2$, at least about 55,000 $mm^2$, at least about 60,000 $mm^2$, at least about 65,000 $mm^2$, at least about 70,000 $mm^2$, at least about 75,000 $mm^2$, at least about 80,000 $mm^2$, at least about 85,000 $mm^2$, at least about 95,000 $mm^2$, at least about 100,000 $mm^2$, at least about 105,000 $mm^2$, at least about 110,000 $mm^2$, at least about 115,000 $mm^2$, at least about 120,000 $mm^2$, at least about 125,000 $mm^2$, at least about 130,000 $mm^2$, at least about 135,000 $mm^2$, at least about 140,000 $mm^2$, at least about 145,000 $mm^2$, or at least about 150,000 $mm^2$. In some embodiments, the surface area of the at least one stabilising element (including one, two, three, four, five, six, or more stabilising elements) is greater than 150,000 $mm^2$.

In additional embodiments, the anchor posts described herein further comprise one or more stabilising element (including, but not limited to, one, two, three, four, five, six, or more stabilising elements) whereby the one or more stabilising element is about 1 millimeter thick, about 2 millimeters thick, about 3 millimeters thick, about 4 millimeters thick, about 5 millimeters thick, about 6 millimeters thick, about 7 millimeters thick, about 8 millimeters thick, about 9 millimeters thick, about 10 millimeters thick, about 11 millimeters thick, about 12 millimeters thick, about 13 millimeters thick, about 14 millimeters thick, about 15 millimeters thick, about 16 millimeters thick, about 17 millimeters thick, about 18 millimeters thick, about 19 millimeters thick, or about 20 millimeters thick.

Referring to one non-limiting embodiment depicted in FIG. 1, three stabilising three dimensional "fin" plates 4 are welded to the surface of the tube at a longitudinal distance of about 100 millimeters from a second end 5, which forms the "head" of the anchor post 1. Each stabilising plate 4 is generally of a three-dimensional trapezoidal configuration and has a height of about 300 millimeters and side lengths of about 75 to about 100 millimeter and about 10 millimeter. The dimensions of each stabilising plate 4 and the position of each stabilising plate 4 will vary depending on the ground conditions, i.e. the substrate into which the anchor post is fixed, as described herein.

Spatial Location Around the Shaft

Another feature of certain embodiments of the subject matter described herein is an anchor post comprising a shaft and at least one stabilising element (including, but not limited to, one, two, three, four, five, six, or more stabilising elements) attached to the anchor post wherein the one or more spatially located stabilising element is configured to resist movement of the anchor post.

For example, in some embodiments, the anchor post comprises a shaft and at least two stabilising elements, wherein the closest degree of separation of any stabilising element in relation to a different stabilising element about the circumference of the shaft is about 5 degrees, about 10 degrees, about 15 degrees, 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees, about 90 degrees, about 95 degrees, about 100 degrees, about 105 degrees, about 110 degrees, about 115 degrees, about 120 degrees, about 125 degrees, about 130 degrees, about 135 degrees, about 140 degrees, about 145 degrees, about 150 degrees, about 155 degrees, about 160 degrees, about 165 degrees, about 170 degrees, about 175 degrees, or about 180 degrees around the circumference of the shaft. In some embodiments, the anchor post comprises a shaft and two stabilising elements, wherein the two stabilising elements are separated by about 180 degrees around the circumference of the shaft. In some embodiments, the anchor posts described herein comprise only one stabilising element.

In further or additional embodiments, the anchor post comprises a shaft and at least three stabilising elements, wherein the closest degree of separation of any two of the at least three stabilising elements about the shaft is about 5 degrees, about 10 degrees, about 15 degrees, 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees, about 90 degrees, about 95 degrees, about 100 degrees, about 105 degrees, about 110 degrees, about 115 degrees, about 120 degrees, about 125 degrees, about 130 degrees, about 135 degrees, about 140 degrees, about 145 degrees, about 150 degrees, about 155 degrees, about 160 degrees, about 165 degrees, about 170 degrees, about 175 degrees, or about 180 degrees around the circumference of the shaft. In some embodiments, the anchor post comprises a shaft and three stabilising elements, wherein the three stabilising elements are separated by about 120 degrees around the circumference of the shaft.

Figure 6:
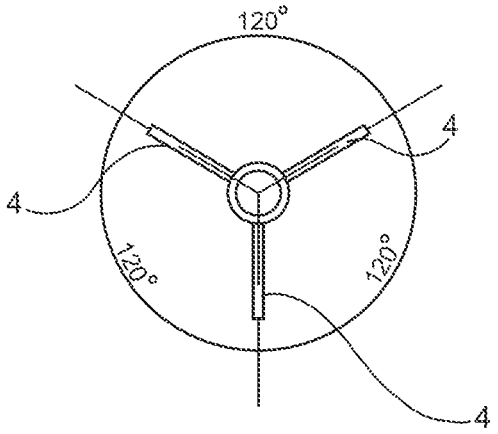
FIG. 6 is a plan view of one embodiment of an anchor post as described herein, depicting the relative positions of one or more stabilising element.

Referring to one non-limiting embodiment depicted in FIG. 6, a stabilising element, e.g. a "fin" element, is welded around the circumference of a tubular shaft 2 and each stabilising element is separated from the adjacent fin by about 120 degrees.

Alignment Element for Anchor Posts and Load Posts

Another feature of certain embodiments of the subject matter described herein is an anchor post that is configured to align with a load post, wherein the anchor post provides support to one or more load post.

The Alignment Element

An additional feature of certain embodiments of the subject matter described herein is an anchor post that is configured to align with a load post, wherein the anchor post provides support to one or more load post by forming about a 180 degree angle between the load post and the anchor post.

In some embodiments, provided herein is an anchor post comprising: (a) a shaft; (b) at least one stabilising element (including but not limited to one, two, three, four, five, six, or more stabilising elements) attached to the anchor post configured to resist movement of the anchor post; and (c) at least one alignment element or attachment means. In some embodiments, the alignment element is configured to ensure the load post and the anchor post form between about a 175 degree angle and about a 180 degree angle with each other. The angle measurements are calculated by measuring the angle formed by the shaft of the anchor post and the shaft of the load post using a protractor or similar device.

In some embodiments, provided herein is an anchor post comprising an alignment element whereby the alignment element is configured to ensure the anchor post and the load post form about a 175 degree angle with each other, about a 175.1 degree angle with each other, about a 175.2 degree angle with each other, about a 175.2 degree angle with each other, about a 175.3 degree angle with each other, about a 175.4 degree angle with each other, about a 175.5 degree angle with each other, about a 175.6 degree angle with each other, about a 175.7 degree angle with each other, about a 175.8 degree angle with each other, about a 175.9 degree angle with each other, about a 176 degree angle with each other, about a 176.1 degree angle with each other, about a 176.2 degree angle with each other, about a 176.3 degree angle with each other, about a 176.4 degree angle with each other, about a 176.5 degree angle with each other, about a 176.6 degree angle with each other, about a 176.7 degree angle with each other, about a 176.8 degree angle with each other, about a 176.9 degree angle with each other, about a 177 degree angle with each other, about a 177.1 degree angle with each other, about a 177.2 degree angle with each other, about a 177.3 degree angle with each other, about a 177.4 degree angle with each other, about a 177.5 degree angle with each other, about a 177.6 degree angle with each other, about a 177.7 degree angle with each other, about a 177.8 degree angle with each other, about a 177.9 degree angle with each other, about a 178 degree angle with each other, about a 178.1 degree angle with each other, about a 178.2 degree angle with each other, about a 178.3 degree angle with each other, about a 178.4 degree angle with each other, about a 178.5 degree angle with each other, about a 178.6 degree angle with each other, about a 178.7 degree angle with each other, about a 178.8 degree angle with each other, about a 178.9 degree angle with each other, about a 179 degree angle with each other, about a 179.1 degree angle with each other, about a 179.2 degree angle with each other, about a 179.3 degree angle with each other, about a 179.4 degree angle with each other, about a 179.5 degree angle with each other, about a 179.6 degree angle with each other, about a 179.7 degree angle with each other, about a 179.8 degree angle with each other, about a 179.9 degree angle with each other, or about a 180 degree angle with each other.

In some embodiments, the alignment plate is a plate, for example a self-alignment plate. In some embodiments, a self-alignment plate is configured to receive one end of a load post with little or no human involvement. For example, in some embodiments, the self-alignment plate is designed as a female end whereby the load post is a male end, and together the female and male end form a tight connection with each other. In further or additional embodiments, an anchor post containing an alignment plate is configured to maintain a load post in a vertical position. In further embodiments, the alignment plate as described herein is configured to prevent movement, including rotational movement, lateral movement and overturning of the load post.

In further embodiments, provided herein is an anchor post comprising an alignment plate whereby the alignment plate is convex. In embodiments with a convex alignment plate, the convex alignment plate is designed to connect to a concave alignment element of a load post. It has been determined that an anchor post with a convex alignment element is advantageous in certain damp or wet environments. For example, in environments prone to precipitation or moisture or potentially prone to precipitation or moisture, a convex plate is utilized to avoid the collection of water at the alignment element connecting the load post and anchor post. In these situations, the convex feature of the alignment element avoids the accumulation of water by facilitating the run-off of the water into, e.g., the surrounding ground material.

In other embodiments, provided herein is an anchor post comprising an alignment plate whereby the alignment plate is concave. In embodiments with a concave alignment plate, the concave alignment plate is designed to connect to a convex alignment element of an anchor post. It has been determined that an anchor post with a concave alignment element is advantageous in certain conditions. For example, in certain soil conditions, it may be desirable to keep small animals and insects away from infestation of the connection of the load post and anchor post. In these situations, the concave feature of the alignment element of the anchor post protects the alignment of the anchor post and the anchor post.

In further embodiments, a convex alignment plate of the anchor post mates or aligns with a concave alignment plate of a load post. In further embodiments, a concave alignment plate of the anchor post mates or aligns with a convex alignment plate of the load post. Thus in certain embodiments, the convex and concave alignment plates as described herein are configured to be "self-aligning."

In other embodiments, provided herein is an anchor post comprising an alignment element whereby the alignment element is configured to connect to a load post with a screw cap. In further embodiments, provided herein is an anchor post comprising an alignment element whereby the alignment element is configured to connect to a load post with a cam. In some embodiments, the cam is a locking device that enables connection of an anchor post and load post when the load post is twisted into a locking position. In further embodiments, the alignment element for connecting the load post to the anchor post is a clip. In still further embodiments, the alignment element is a device suitable to connect a load post to an anchor post.

In some embodiments, provided herein is an anchor post comprising: (a) a shaft; (b) at least one stabilising element (including but not limited to one, two, three, four, five, six, or more stabilising elements) attached to the anchor post configured to resist movement of the anchor post; and (c) at least one attachment means. In some embodiments the attachment means is convex. In further or additional embodiments, the attachment means is concave.

Figure 7:
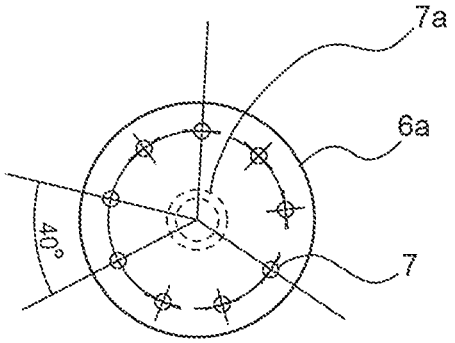
FIG. 7 is a vertical view of one embodiment of an anchor post, depicting an alignment element of the anchor post that is configured to connect to and provide support to at least one load post.

Referring to a depiction in FIG. 7 of one non-limiting embodiment, an alignment plate or attachment means 6*a* is welded to the "head" 5 of the anchor post 1 and comprises an alignment plate which is of thickness of about 1 millimeter to about 100 millimeters, including any integer within the range, for example, 1 millimeter, 2 millimeters, 3 millimeters, 4 millimeters, 5 millimeters, 6 millimeters, 7 millimeters, etc. In some embodiments, provided herein is an alignment plate of a thickness of about 12 millimeters.

In further or additional embodiments, the alignment element is drilled with holes, slots or apertures to receive about a 16 millimeter diameter bolt. In further embodiments, the alignment element is attached to the anchor post dependent on its intended use of the anchor post. For example, in some embodiments, an alignment element, e.g. the alignment plate, is attached to an anchor post by bracketing. In further embodiments, the bracketing will ensure the load post will remain vertical and prevents rotational movement.

In further or additional embodiments, referring to a depiction in FIG. 7 of one non-limiting embodiment of the subject matter described herein, one or more aperture is drilled around the alignment plate with about a 10, about a 20, about a 30, about a 40, about a 50, about a 60, about a 70, about a 80, about a 90, about a 100, about a 110, about a 120, about a 130, about a 140, about a 150, about a 160, about a 170, about a 175, or about 180 degree separation between adjacent apertures. In further embodiments, each aperture is equidistant from the center of the plate. In some embodiments, each aperture is not equidistant from the center of the plate. In some embodiments, the alignment plate contains a central aperture as depicted in FIG. 7 as 7*a*, which in further embodiments is filled with cement once the anchor post is installed into the ground. In further embodiments with an alignment plate with a central aperture, the central aperture is covered with a patch of bitumen-based material. In other embodiments, the alignment plate does not contain a central aperture or if it does contain a central aperture, it is not filled with cement once it is installed into ground.

In further or additional embodiments, referring to a depiction in FIGS. 9 and 10, the alignment plate 6*a* and 6*b* are attached to the anchor post 1 and load post 10, respectively. In this embodiment, the anchor post 1 and the load post 10 are configured to be self-aligning. In further embodiments as depicted in FIGS. 9 and 10, the anchor post 1 and alignment plate 6*a* comprises a convex plate. The load post 10 alignment element comprises a concave plate. In further embodiments, the anchor post 1 is fixed in position below the ground and the load post 10 is mounted above the anchor post 1. In further embodiments, a concave plate 6*b* is attached to a load post 10, whereby the concave plate connects to a convex plate 6*a*, thereby aligning the two alignment plates. The alignment plate 6*a* and 6*b* are then connected, for example with bolts, thereby ensuring the load post 10 is aligned with the anchor post.

Figure 13:
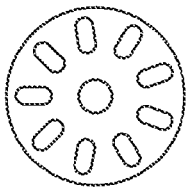
FIG. 13 is a view of one or more embodiments of an alignment element configured with apertures as described herein.

Referring to another non-limiting embodiment, FIG. 13 depicts an alignment plate in the form of a hemispherical domed plate, whereby the hemispherical dome plate contains nine apertures configured for connection to a load post with use of additional hardware, e.g. bolts, washers, nuts, etc.

Figure 14:
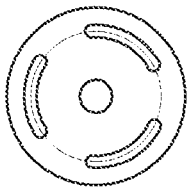
FIG. 14 is a view of one or more embodiments of an alignment element configured with slots as described herein.

Referring to another non-limiting embodiment, FIG. 14 depicts an alignment plate in the form of a hemispherical domed plate, whereby the hemispherical dome plate contains three slots configured for connection to a load post with use of additional hardware, e.g. bolts, washers, nuts, etc.

An additional feature of certain embodiments of the subject matter provided herein is an anchor post is configured to connect with a load post whereby the connection is made possible with an alignment element. In some embodiments, provided herein is an anchor post that is configured to connect to a load post whereby the connection is made possible without inserting the load post into the anchor post or without inserting a substantial portion of the load post into the anchor post.

In some embodiments, the anchor posts described herein comprise an alignment element that is configured to connect to at least one load post without inserting a substantial portion of the load post into the anchor post. These anchor posts offer significant advantages over the existing anchor posts. For example, in some embodiments, the anchor posts provided herein are configured to connect to a load post without inserting any or a substantial portion of the load post into an internal socket, thereby preventing re-alignment problems in the event the anchor post was inserted into the ground at a less than desirable angle, e.g. an angle less than 180 degrees with the desired angle of the load post.

In some embodiments, provided herein is an anchor post comprising: (a) a shaft; (b) at least one stabilising element (including but not limited to one, two, three, four, five, six, or more stabilising elements) attached to the anchor post configured to resist movement of the anchor post; and (c) at least one alignment element that is configured to connect to at least one load post without inserting the load post into the anchor post.

In additional embodiments, provided herein is an anchor post comprising: (a) a shaft; (b) at least one stabilising element (including but not limited to one, two, three, four, five, six, or more stabilising elements) attached to the anchor post configured to resist movement of the anchor post; and (c) at least one alignment element that is configured to connect to at least one load post without inserting a substantial portion of the load post into the anchor post.

In some embodiments, a "substantial" portion of the load post is from about 0.1 millimeters to about 100 millimeters, including every millimeter integer of anchor post in between, for example, 1 millimeter, 2 millimeters, 3 millimeters, 4 millimeters, 5 millimeters, 6 millimeters, etc. In further embodiments, an anchor post comprising an alignment element is configured to connect to a load post while inserting less than about 100 millimeters of load post into the anchor post, less than about 98 millimeters of load post into the anchor post, less than about 96 millimeters of load post into the anchor post, less than about 94 millimeters of load post into the anchor post, less than about 92 millimeters of load post into the anchor post, less than about 90 millimeters of load post into the anchor post, less than about 88 millimeters of load post into the anchor post, less than about 86 millimeters of load post into the anchor post, less than about 84 millimeters of load post into the anchor post, less than about 82 millimeters of load post into the anchor post, less than about 80 millimeters of load post into the anchor post, less than about 78 millimeters of load post into the anchor post, less than about 76 millimeters of load post into the anchor post, less than about 74 millimeters of load post into the anchor post, less than about 72 millimeters of load post into the anchor post, less than about 70 millimeters of load post into the anchor post, less than about 68 millimeters of load post into the anchor post, less than about 66 millimeters of load post into the anchor post, less than about 64 millimeters of load post into the anchor post, less than about 62 millimeters of load post into the anchor post, less than about 60 millimeters of load post into the anchor post, less than about 58 millimeters of load post into the anchor post, less than about 56 millimeters of load post into the anchor post, less than about 54 millimeters of load post into the anchor post, less than about 52 millimeters of load post into the anchor post, less than about 50 millimeters of load post into the anchor post, less than about 48 millimeters of load post into the anchor post, less than about 46 millimeters of load post into the anchor post, less than about 44 millimeters of load post into the anchor post, less than about 42 millimeters of load post into the anchor post, less than about 40 millimeters of load post into the anchor post, less than about 38 millimeters of load post into the anchor post, less than about 36 millimeters of load post into the anchor post, less than about 34 millimeters of load post into the anchor post, less than about 32 millimeters of load post into the anchor post, less than about 30 millimeters of load post into the anchor post, less than about 28 millimeters of load post into the anchor post, less than about 26 millimeters of load post into the anchor post, less than about 24 millimeters of load post into the anchor post, less than about 22 millimeters of load post into the anchor post, less than about 20 millimeters of load post into the anchor post, less than about 19 millimeters of load post into the anchor post, less than about 18 millimeters of load post into the anchor post, less than about 17 millimeters of load post into the anchor post, less than about 16 millimeters of load post into the anchor post, less than about 15 millimeters of load post into the anchor post, less than about 14 millimeters of load post into the anchor post, less than about 13 millimeters of load post into the anchor post, less than about 12 millimeters of load post into the anchor post, less than about 11 millimeters of load post into the anchor post, less than about 10 millimeters of load post into the anchor post, less than about 9 millimeters of load post into the anchor post, less than about 8 millimeters of load post into the anchor post, less than about 7 millimeters of load post into the anchor post, less than about 6 millimeters of load post into the anchor post, less than about 5 millimeters of load post into the anchor post, less than about 4 millimeters of load post into the anchor post, less than about 3 millimeters of load post into the anchor post, less than about 2 millimeters of load post into the anchor post or less than about 1 millimeter of load post into the anchor post, less than about 0.5 millimeters of load post into the anchor post, or inserting 0 millimeters of load post into the anchor post.

In some embodiments, provided herein is an anchor post comprising: (a) a shaft; (b) at least one stabilising element (including but not limited to one, two, three, four, five, six, or more stabilising elements) attached to the anchor post configured to resist movement of the anchor post; and (c) at least one alignment element that is configured to connect to at least one load post, whereby a substantial portion of the load post is inserted into the anchor post.

In further or additional embodiments, provided herein is an anchor post comprising: (a) a shaft; and (b) at least one stabilising element (including but not limited to one, two, three, four, five, six, or more stabilising elements) attached to the anchor post configured to resist movement of the anchor post; wherein the anchor post does not contain an internal socket for insertion of a load post. For example, in some embodiments, the anchor posts described herein does not contain an internal socket for receiving a load post or guide post. In further or additional embodiments, the anchor posts described herein do not contain an internal socket containing a retaining means located adjacent to the internal socket for effecting release of a guide post or load post from the internal socket. In further or additional embodiments, the anchor posts described herein do not contain an engageable latch projection to effectuate release of a retaining means.

The Adjustable Alignment Element

An additional feature of certain embodiments of the subject matter described herein is an anchor post that is configured to align with a load post, wherein the anchor post provides support to one or more load post by forming about a 180 degree angle with the load post.

In some embodiments, provided herein is an anchor post comprising: (a) a shaft; (b) at least one stabilising element (including but not limited to one, two, three, four, five, six, or more stabilising elements) attached to the anchor post configured to resist movement of the anchor post; and (c) at least one alignment element, whereby the alignment element is configured to compensate for imprecision during the installation of the anchor post or the alignment element is configured to compensate for a ground surface angle that is not perpendicular with the anchor post.

For example, it has been discovered that during the installation processes of the anchor posts described herein, the anchor post is installed into the ground in a less than desirable manner, or is installed in a difficult ground area or surroundings. For example, in some situations, the anchor post is installed into the ground in a manner where the anchor post is not perpendicular with the ground surface, but a load post that is perpendicular with the surface is desired. Or, to take another example, in some circumstances the anchor post may be installed into an enbankment or other ground surface whereby it is not desirable to have a load post erected that is perpendicular with the surface, but rather it is desirable to erect a load post that forms an angle with the embankment. In these and other situations, it is desirable to have an anchor post that is configured to connect to a load post whereby the anchor post and the load post form less than about a 180 degree angle.

In further embodiments, a convex alignment plate of the anchor post mates or aligns with a concave alignment plate of a load post. In further embodiments, a concave alignment plate of the anchor post mates or aligns with a convex alignment plate of the load post. Thus in certain embodiments, the convex and concave alignment plates as described herein are configured to be "self-aligning."

For example, in some embodiments the anchor posts described herein comprise an alignment element that contains one or more aperture. In further embodiments, the anchor posts described herein contain an alignment element with one aperture, two apertures, three aperture, four apertures, five apertures, six apertures, seven apertures, either apertures, nine apertures, ten apertures, eleven or more apertures. The apertures are configured for connection to an alignment element anchor post with use of additional hardware, e.g. bolts, washers, nuts, etc.

In still further embodiments, the anchor posts described herein contain an alignment element that contains one or more slot. In further embodiments, the anchor posts described herein comprise an alignment element that contains one slot, two slots, three slots, four slots, five slots, six slots, seven slots, or eight or more slots. In still further embodiments, the anchor posts described herein are configured to connect to a load post containing an alignment element with an adjustable hinge or joint. In still further embodiments, provided herein is an alignment element comprising an anchor post containing a hemispheric ball-joint.

In some embodiments, provided herein is an anchor post comprising an adjustable joint or hinge, whereby the adjustable joint or hinge is configured to ensure the anchor post and the load post form less than a 180 degree angle. In further or additional embodiments, provided herein is an anchor post comprising an adjustable joint or hinge, whereby the adjustable joint or hinge is configured to ensure the anchor post and the load post form an angle between about 160 degrees and about 180 degrees. The angle measurements are calculated by measuring the angle formed by the shaft of the anchor post and the shaft of the load post using a protractor or similar device.

In some embodiments, provided herein is an anchor post comprising an adjustable joint or hinge, whereby the adjustable joint or hinge is configured to ensure the anchor post and the load post form about a 160 degree angle with each other, about a 160.1 degree angle with each other, about a 160.2 degree angle with each other, about a 160.2 degree angle with each other, about a 160.3 degree angle with each other, about a 160.4 degree angle with each other, about a 160.5 degree angle with each other, about a 160.6 degree angle with each other, about a 160.7 degree angle with each other, about a 160.8 degree angle with each other, about a 160.9 degree angle with each other, about a 161 degree angle with each other, about a 161.1 degree angle with each other, about a 161.2 degree angle with each other, about a 161.3 degree angle with each other, about a 161.4 degree angle with each other, about a 161.5 degree angle with each other, about a 161.6 degree angle with each other, about a 161.7 degree angle with each other, about a 161.8 degree angle with each other, about a 161.9 degree angle with each other, about a 162 degree angle with each other, about a 162.1 degree angle with each other, about a 162.2 degree angle with each other, about a 162.3 degree angle with each other, about a 162.4 degree angle with each other, about a 162.5 degree angle with each other, about a 162.6 degree angle with each other, about a 162.7 degree angle with each other, about a 162.8 degree angle with each other, about a 162.9 degree angle with each other, about a 163 degree angle with each other, about a 163.1 degree angle with each other, about a 163.2 degree angle with each other, about a 163.3 degree angle with each other, about a 163.4 degree angle with each other, about a 163.5 degree angle with each other, about a 163.6 degree angle with each other, about a 163.7 degree angle with each other, about a 163.8 degree angle with each other, about a 163.9 degree angle with each other, about a 164 degree angle with each other, about a 164.1 degree angle with each other, about a 164.2 degree angle with each other, about a 164.3 degree angle with each other, about a 164.4 degree angle with each other, about a 164.5 degree angle with each other, about a 164.6 degree angle with each other, about a 164.7 degree angle with each other, about a 164.8 degree angle with each other, about a 164.9 degree angle with each other, about a 165 degree angle with each other, about a 165.1 degree angle with each other, about a 165.2 degree angle with each other, about a 165.3 degree angle with each other, about a 165.4 degree angle with each other, about a 165.5 degree angle with each other, about a 165.6 degree angle with each other, about a 165.7 degree angle with each other, about a 165.8 degree angle with each other, about a 165.9 degree angle with each other, or about a 166 degree angle with each other.

In further embodiments, provided herein is an anchor post comprising an alignment element whereby the alignment element is configured to ensure the anchor post and the load post form about a 166.1 degree angle with each other, about a 166.2 degree angle with each other, about a 166.2 degree angle with each other, about a 166.3 degree angle with each other, about a 166.4 degree angle with each other, about a 166.5 degree angle with each other, about a 166.6 degree angle with each other, about a 166.7 degree angle with each other, about a 166.8 degree angle with each other, about a 166.9 degree angle with each other, about a 167 degree angle with each other, about a 167.1 degree angle with each other, about a 167.2 degree angle with each other, about a 167.3 degree angle with each other, about a 167.4 degree angle with each other, about a 167.5 degree angle with each other, about a 167.6 degree angle with each other, about a 167.7 degree angle with each other, about a 167.8 degree angle with each other, about a 167.9 degree angle with each other, about a 168 degree angle with each other, about a 168.1 degree angle with each other, about a 168.2 degree angle with each other, about a 168.3 degree angle with each other, about a 168.4 degree angle with each other, about a 168.5 degree angle with each other, about a 168.6 degree angle with each other, about a 168.7 degree angle with each other, about a 168.8 degree angle with each other, about a 168.9 degree angle with each other, about a 169 degree angle with each other, about a 169.1 degree angle with each other, about a 169.2 degree angle with each other, about a 169.3 degree angle with each other, about a 169.4 degree angle with each other, about a 169.5 degree angle with each other, about a 169.6 degree angle with each other, about a 169.7 degree angle with each other, about a 169.8 degree angle with each other, about a 169.9 degree angle with each other, about a 170 degree angle with each other, about a 170.1 degree angle with each other, about a 170.2 degree angle with each other, about a 170.3 degree angle with each other, about a 170.4 degree angle with each other, about a 170.5 degree angle with each other, about a 170.6 degree angle with each other, about a 170.7 degree angle with each other, about a 170.8 degree angle with each other, about a 170.9 degree angle with each other, or about a 171 degree angle with each other.

In still further embodiments, provided herein is an anchor post comprising an alignment element whereby the alignment element is configured to ensure the anchor post and the load post form about a 171.1 degree angle with each other, about a 171.2 degree angle with each other, about a 171.2 degree angle with each other, about a 171.3 degree angle with each other, about a 171.4 degree angle with each other, about a 171.5 degree angle with each other, about a 171.6 degree angle with each other, about a 171.7 degree angle with each other, about a 171.8 degree angle with each other, about a 171.9 degree angle with each other, about a 172 degree angle with each other, about a 172.1 degree angle with each other, about a 172.2 degree angle with each other, about a 172.3 degree angle with each other, about a 172.4 degree angle with each other, about a 172.5 degree angle with each other, about a 172.6 degree angle with each other, about a 172.7 degree angle with each other, about a 172.8 degree angle with each other, about a 172.9 degree angle with each other, about a 173 degree angle with each other, about a 173.1 degree angle with each other, about a 173.2 degree angle with each other, about a 173.3 degree angle with each other, about a 173.4 degree angle with each other, about a 173.5 degree angle with each other, about a 173.6 degree angle with each other, about a 173.7 degree angle with each other, about a 173.8 degree angle with each other, about a 173.9 degree angle with each other, about a 174 degree angle with each other, about a 174.1 degree angle with each other, about a 174.2 degree angle with each other, about a 174.3 degree angle with each other, about a 174.4 degree angle with each other, about a 174.5 degree angle with each other, about a 174.6 degree angle with each other, about a 174.7 degree angle with each other, about a 174.8 degree angle with each other, about a 174.9 degree angle with each other, about a 175 degree angle with each other, about a 175.1 degree angle with each other, about a 175.2 degree angle with each other, about a 175.3 degree angle with each other, about a 175.4 degree angle with each other, about a 175.5 degree angle with each other, about a 175.6 degree angle with each other, about a 175.7 degree angle with each other, about a 175.8 degree angle with each other, about a 175.9 degree angle with each other, or about a 176 degree angle with each other.

In yet further embodiments, provided herein is an anchor post comprising an alignment element whereby the alignment element is configured to ensure the anchor post and the load post form about a 176.1 degree angle with each other, about a 176.2 degree angle with each other, about a 176.3 degree angle with each other, about a 176.4 degree angle with each other, about a 176.5 degree angle with each other, about a 176.6 degree angle with each other, about a 176.7 degree angle with each other, about a 176.8 degree angle with each other, about a 176.9 degree angle with each other, about a 177 degree angle with each other, about a 177.1 degree angle with each other, about a 177.2 degree angle with each other, about a 177.3 degree angle with each other, about a 177.4 degree angle with each other, about a 177.5 degree angle with each other, about a 177.6 degree angle with each other, about a 177.7 degree angle with each other, about a 177.8 degree angle with each other, about a 177.9 degree angle with each other, about a 178 degree angle with each other, about a 178.1 degree angle with each other, about a 178.2 degree angle with each other, about a 178.3 degree angle with each other, about a 178.4 degree angle with each other, about a 178.5 degree angle with each other, about a 178.6 degree angle with each other, about a 178.7 degree angle with each other, about a 178.8 degree angle with each other, about a 178.9 degree angle with each other, about a 179 degree angle with each other, about a 179.1 degree angle with each other, about a 179.2 degree angle with each other, about a 179.3 degree angle with each other, about a 179.4 degree angle with each other, about a 179.5 degree angle with each other, about a 179.6 degree angle with each other, about a 179.7 degree angle with each other, about a 179.8 degree angle with each other, about a 179.9 degree angle with each other, or about a 180 degree angle with each other.

In further embodiments, the adjustable joint or hinge comprises a convex alignment plate. In these situations, the convex alignment plate of the anchor post mates or aligns with a concave alignment plate of a load post. Thus in certain embodiments, the convex and concave alignment plates as described herein are configured to be "self-aligning" adjustable joint.

In further embodiments, the adjustable joint or hinge comprises a concave alignment plate. In these situations, the concave alignment plate of the anchor post mates or aligns with a convex alignment plate of the load post. Thus in certain embodiments, the convex and concave alignment plates as described herein are configured to form a "self-aligning" adjustable joint.

In some embodiments, provided herein is an alignment element comprising an adjustable joint wherein the adjustable joint is a ball joint. For example, in further or additional embodiments, the adjustable joint is a hemispheric ball-joint or similar device.

Load Posts

Another feature of certain embodiments of the subject matter described herein is a load post that is configured to connect to an anchor post whereby the anchor post can provide stability and support to the load post.

In some embodiments, provided herein is an anchor post comprising: (a) a shaft; and (b) at least one stabilising element (including but not limited to one, two, three, four, five, six, or more stabilising elements) attached to the anchor post configured to resist movement of the anchor post; wherein the anchor post is configured to connect to a load post.

In some embodiments, the load post is a support device used in railroad construction or support, highway construction or support, residential construction or support, commercial construction or support, recreational construction or support, or any other construction or support application.

In further or additional embodiments, the load post is, forms, is attached to, or is used to support, a cable post, a gabion support, a barrier, a rockfall barrier, a mooring bollard, a buoy, a seabed matting, a floating dock, a park bench, a covered recreational facility (e.g. a gymnasium, tennis court, basketball court, or a volleyball court), a bicycle path sign, a railroad sign, a highway sign, a road sign, railroad fencing, motorway fencing, a railroad fence, a railroad trackside cable, a retaining post, a retaining fence, a road sign, a road fence, playground equipment, a park bench, a handrail, a pipeline anchor, a pedestrian sign, a sheet pile, a trench sheet, a retaining wall, a secant wall, a road embankment, a rail embankment, a sloping ground, a lock wall, a canal wall, a tunnel lining, a gabion basket, a revetment matting, a coastal defense structure, a cliff stabilizer, an overhead gantry, a geotextile support, a scaffold, a guyed structure, a mast, a temporary re-locatable structure, a pipeline, a tree kit, a ski mat, a security chain, a security lock, a crash barrier, a fence, a handrail, a machinery anchor, a bridge, a retaining wall, or similar device.

In some embodiments, the load posts provided herein further comprise an alignment element or attachment means for connection to an anchor post as described herein, including all of the specific embodiments of the alignment element and attachment means as provided herein with respect to the alignment element of the anchor post. In further embodiments, the load posts described herein contain an alignment element that is configured to connect to a corresponding alignment element of the anchor post.

In further embodiments, a convex alignment plate of a load post mates or aligns with a concave alignment plate of an anchor post. In further embodiments, a concave alignment plate of a load post mates or aligns with a convex alignment plate of the anchor post. Thus in certain embodiments, the convex and concave alignment plates as described herein are configured to be "self-aligning."

For example, in some embodiments the load posts described herein comprise an alignment element that contains one or more aperture. In further embodiments, the load posts described herein contain an alignment element with one aperture, two apertures, three aperture, four apertures, five apertures, six apertures, seven apertures, either apertures, nine apertures, ten apertures, eleven or more apertures. The apertures are configured for connection to an alignment element anchor post with use of additional hardware, e.g. bolts, washers, nuts, etc.

In still further embodiments, the load posts described herein contain an alignment element that contains one or more slot. In further embodiments, the load posts described herein comprise an alignment element that contains one slot, two slots, three slots, four slots, five slots, six slots, seven slots, or eight or more slots. In still further embodiments, the load posts described herein are configured to connect to an anchor post containing an alignment element with an adjustable hinge or joint. In still further embodiments, provided herein is an alignment element comprising a load post containing a hemispheric ball-joint.

Figure 4:
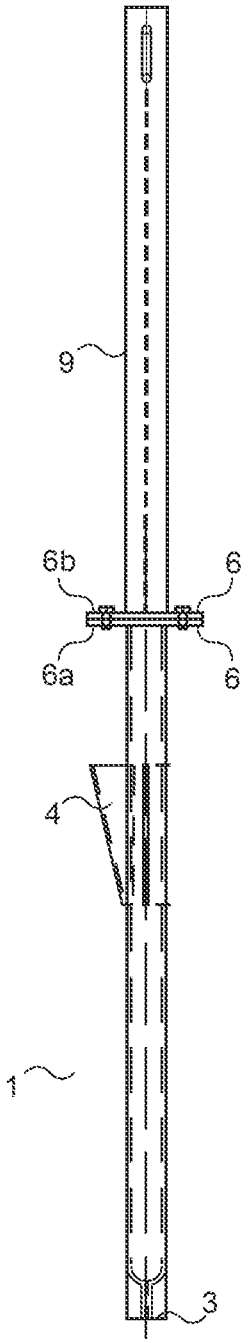
FIG. 4 is a perspective view of one embodiment of an anchor post as described herein, depicting the anchor post attached to a load post.
Figure 5:
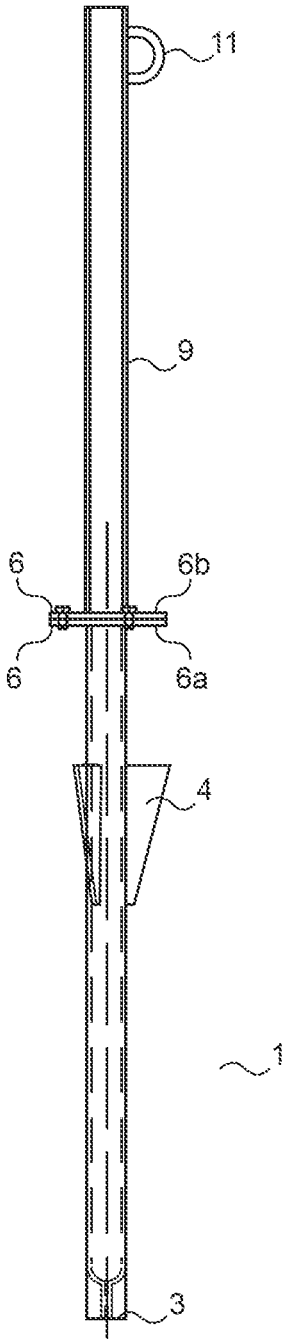
FIG. 5 is a further perspective view of one embodiment of an anchor post as described herein, depicting the anchor post attached to a load post.

Reference is made to FIGS. 4 and 5 which depict one or more non-limiting embodiment of the subject matter described herein. In some embodiments, the anchor post 1 is installed into the ground, whereby the load post 9 is mounted above the ground. The respective alignment plates or attachment means 6*a* and/or 6*b* of the anchor post 1 and the load post 9 are utilized to connect the anchor post to the load post, thereby utilizing the anchor post 1 to provide stability and support to the load post 9.

Figure 3:
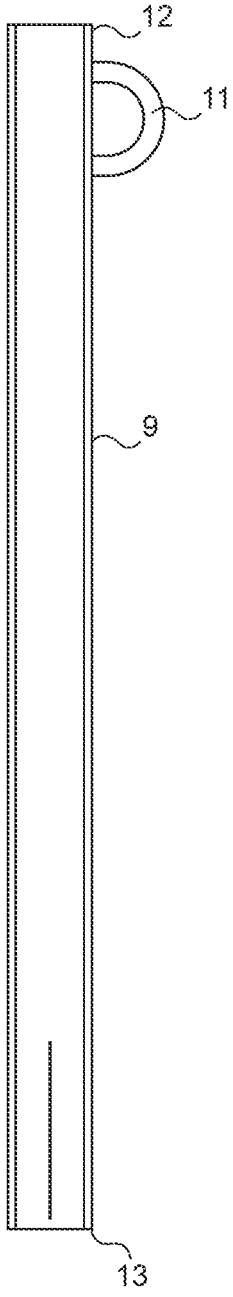
FIG. 3 is a cross sectional view of one embodiment of a load post as described herein.

Referring to one non-limiting embodiment depicted in FIG. 3, a load post 9 comprising a steel tube and an optional hoop 11 of about 10 degrees, about 20 degrees, about 30 degrees, about 40 degrees, or about 50 degrees that is welded to one end 12 of the load post. The hoop 11 in one embodiment depicted in FIG. 3 is about 60 millimeters, about 70 millimeters, about 80 millimeters, about 90 millimeters, about 100 millimeters, about 110 millimeters, about 120 millimeters, about 130 millimeters, about 140 millimeters, about 150 millimeters or about 160 millimeters wide and about 40 millimeters, about 50 millimeters, about 60 millimeters, about 70 millimeters, about 80 millimeters, about 90 millimeters, about 100 millimeters, about 110 millimeters, or about 120 millimeters wide and about 40 millimeters, about 50 millimeters, about 60 millimeters, about 70 millimeters, about 80 millimeters, about 90 millimeters, about 100 millimeters, about 110 millimeters, or about 120 millimeters in height. In certain embodiments, an alignment plate or attachment means (not shown in FIG. 3) is welded to the end 13 of the load post 11.

In some embodiments, the load posts described herein are comprised of steel, for example, recycled steel, stainless steel, cast iron, graphite iron, glass reinforced fiber, extruded resin plastics, pulltruded plastic, molded plastic, or other suitable material(s), or a combination thereof.

Figure 17:
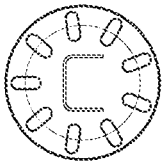
FIG. 17 is a view of one embodiment of the alignment plate of a load post containing at least one aperture.
Figure 16:
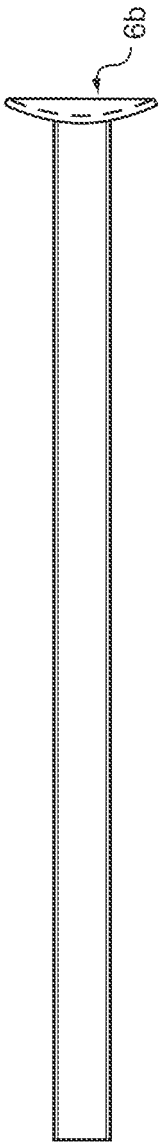
FIG. 16 is a cross sectional view of a load post comprising an alignment element.
Figure 15:
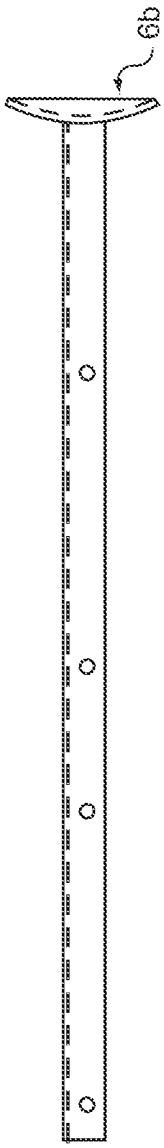
FIG. 15 is a cross sectional view of a load post comprising an alignment element.

FIGS. 15, 16, 17 and 18 depict several non-limiting embodiments of the subject matter described herein. FIGS. 15 and 16 depict a load post of length of about 1250 millimeters comprising an alignment plate 6*b*. FIG. 17 depicts a view of one embodiment of the alignment plate of a load post, whereby the plate is a hemispherical domed plate and contains about nine apertures that are configured for connection to an anchor post with use of additional hardware, e.g. bolts, washers, nuts, etc. See also FIG. 7, depicting an alignment element with nine apertures, whereby each aperture is located 40 degrees from the next in a circumferential manner around the alignment plate.

Figure 8:
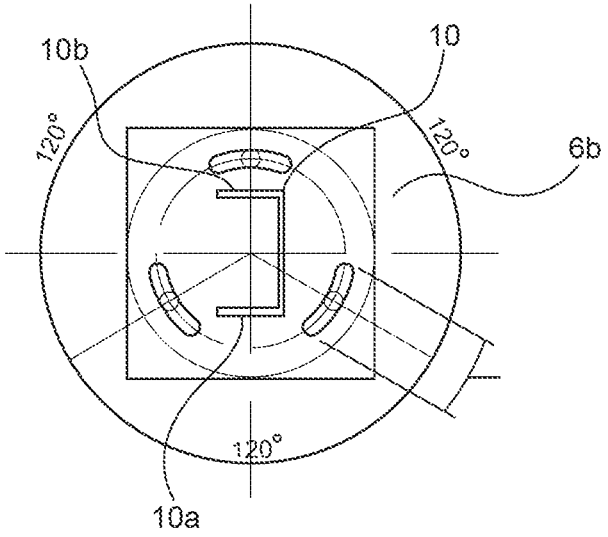
FIG. 8 is a vertical view of one embodiment depicting an element that is configured to provide connect to and provide support to a load post.
Figure 18:
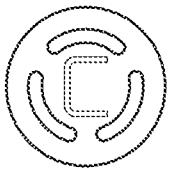
FIG. 18 is a view of one embodiment of the alignment plate of a load post, whereby the plate containing at least one curved slot.

FIG. 18 depicts a view of one embodiment of the alignment element of a load post, whereby the element is a hemispherical domed plate and contains three curved slots that are configured for connection to an anchor post with use of additional hardware, e.g. bolts, washers, nuts, etc. See also FIG. 8, depicting an alignment element with three slots.

An additional feature of certain embodiments of the subject matter described herein is a load post that is configured to connect with one or more lateral support.

Also provided herein is a is an anchor post comprising: (a) a shaft; (b) at least one stabilising element (including but not limited to one, two, three, four, five, six, or more stabilising elements) attached to the anchor post configured to resist movement of the anchor post; and (c) an alignment element that is configured to attach to a load post, wherein the load post is optionally connected to a lateral support.

For example, in some embodiments, the one or more lateral support is a rail optionally comprising an angle bracket. In further or additional embodiments, provided herein is a lateral support that is configured to attach to a load post, whereby the lateral support is designed to provide flexibility. In further embodiments, the brackets connecting one or more lateral support to one or more load post is configured in a flexible manner to permit bending of the lateral support, load post, or combination thereof. In further embodiments, the one or more lateral support as described herein is configured for installation on an inclination in an upward or downward plane without causing undue stress on any structural component, for example an anchor post, a lateral support, or a load post.

Figure 19:
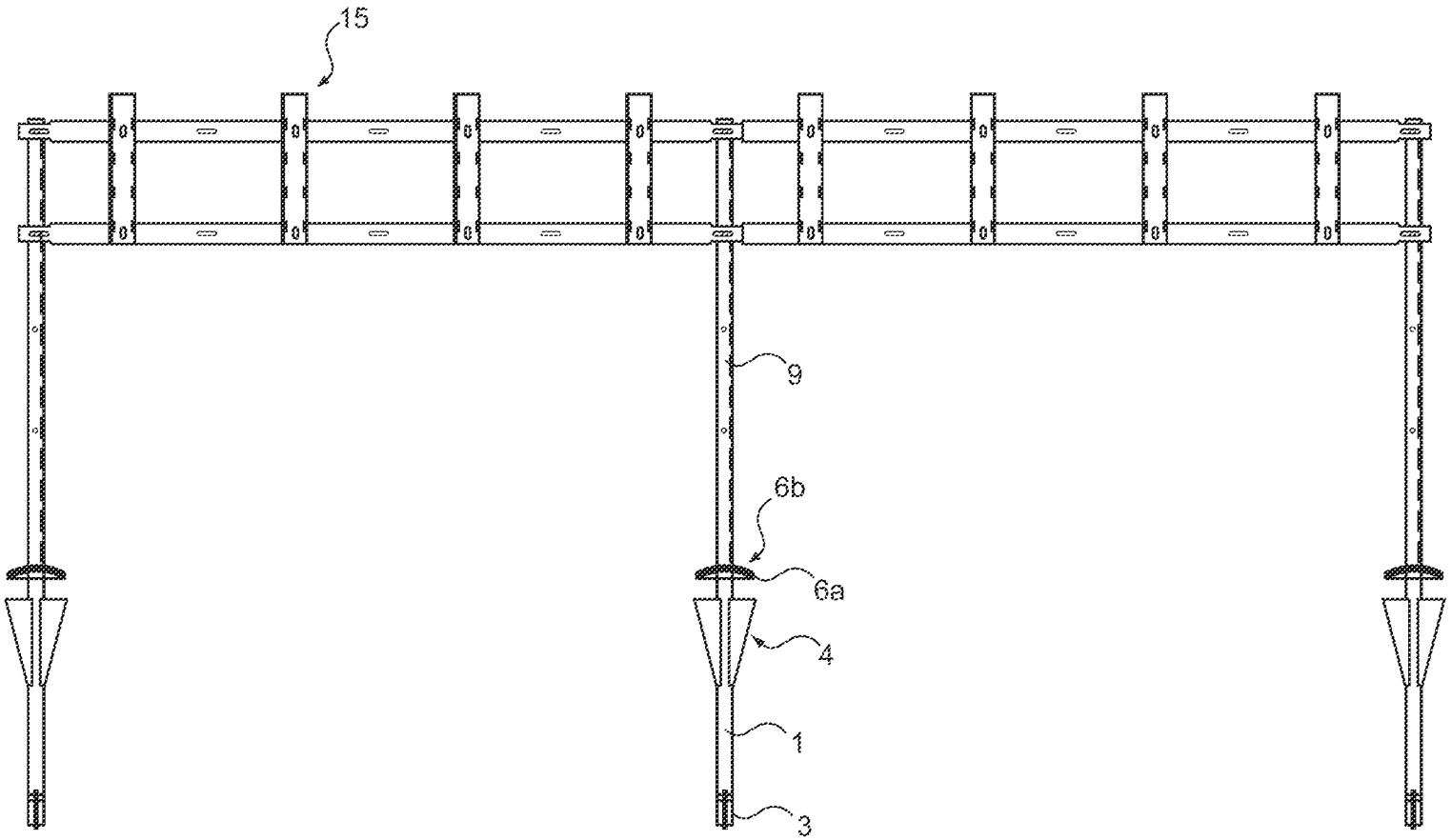
FIG. 19 is a view of the anchor post system depicting three anchor posts, three load posts, and at least one lateral support that is connected to at least one load post.

In one embodiment depicted in FIG. 19, provided is an overview of the anchor post system as described herein. Depicted is an anchor post 1 installed into the ground, one or more stabilising element 4 attached to the shaft of the anchor post, a load post 9, an alignment element 6*a* attached to the anchor post, an alignment element 6*b* attached to the load post, whereby the alignment elements 6*a* and 6*b* connect to each other, and a lateral support 15.

Additional System Components

Another feature of certain embodiments of the subject matter described herein is a fully integrated system comprising an anchor post that further comprises a shaft and at least one stabilising element whereby the system optionally comprises one or more additional component.

In some embodiments, provided herein is a system comprising (a) an anchor post comprising a shaft and at least one stabilising element attached to the anchor post configured to resist movement of the anchor post, and (b) a load post that is configured to connect to an anchor post. In some embodiments, the load post is configured to attach or connect to an anchor post without inserting a substantial portion of the load post into the anchor post. In further or additional embodiments, the load post is configured to attach or connect to the anchor post using one or more self-aligning plate.

In further or additional embodiments, provided herein is a system comprising an anchor post, including aspects of anchor systems described in the multitude of embodiments herein, a load post, including aspects of the load post described in the multitude of embodiments herein, and optionally one or more additional component. In some embodiments, the one or more additional component is a lateral support device, including aspects described in the multitude of embodiments described herein. In further embodiments, the one or more component is a scanning device to detect for objects underground that may impede the driving of the anchor post into the ground (e.g. a CAT scanner), a device to bottom-drive anchor posts into the ground (e.g. an anti-vibrational hammer with optional hose), a drive-rod, an extraction winch, or a power pack, or similar devices.

Methods of Installation

Another feature of certain embodiments of the subject matter described herein is an efficient method of installation of one or more anchor posts described herein into the ground. For example, in some embodiments, the anchor posts described herein is installed into the ground by a method of driving into the ground an anchor post, wherein the anchor post comprises a shaft, at least one stabilising element attached to the anchor post configured to resist movement of the anchor post, and at least one alignment element that is configured to connect to at least one load post. In some embodiments, the alignment element of the anchor post is configured to connect to a load post without inserting a substantial portion of the load post into the anchor post.

In some embodiments, the alignment plate is used to connect an anchor post to a load post at ground level. In other embodiments, the alignment plate is configured to connect an anchor post to a load post below ground level. In further or additional embodiments, the alignment plate is used to connect an anchor post above ground level.

It has been determined that an anchor post that resists or prevents movement can be percussion driven, thereby allowing for quicker installation by a professional crew without the use of heavy duty machinery. It is estimated that the anchor post of the present invention could be installed at a rate of at least 15 posts per hour, which is more time and cost effective and is a specific advantage over the prior art as described herein.

In some embodiments, the anchor posts described herein are installed into the ground using a percussion driven device. In some embodiments, a hand-held device is used to install an anchor post into the ground. In further embodiments, the percussion-driven device or the hand-held device is an electronic hammer, an anti-vibration hammer, a hydraulic hammer, a pneumatic hammer, a jack-hammer, a breaker, or a similar device. In further or additional embodiments, as described herein, an anchor post is bottom-driven into the ground when a drive rod is inserted into the shaft. In further embodiments, an anchor post is hand driven into the ground using a small power pack and hand held hammer. In alternative embodiments, an anchor post is machine driven into the ground using a small excavator fitted with a hammer head. In some embodiments the percussion driven device provides about 50 Joules of energy, about 60 Joules of energy, about 70 Joules of energy, about 80 Joules of energy, about 90 Joules of energy, about 100 Joules of energy, about 110 Joules of energy, about 120 Joules of energy, about 130 Joules of energy, about 140 Joules of energy, about 150 Joules of energy, about 160 Joules of energy, about 170 Joules of energy, about 180 Joules of energy, about 190 Joules of energy, about 200 Joules of energy, about 210 Joules of energy, about 220 Joules of energy, about 210 Joules of energy, about 220 Joules of energy, about 230 Joules of energy, or about 240 Joules of energy.

While embodiments of the presently disclosed subject matter have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

EXAMPLES

Example 1: Drive Time Rates for 1200 mm Anchor Posts

In a field test it was found that the time taken to insert a 1200 millimeter anchor post 1200 millimeters into a controlled displaceable ground material offered a significant improvement over existing anchor posts. The controlled displaceable ground material was prepared by making a uniform mixture of wet clay, broken bricks and concrete rubble reasonably well compacted. In controlled tests, a 3.0 kN load was applied at 1.2 m above ground level. The drive time to a working depth for an anchor post length of 1200 mm was found to be about 60 seconds. After the anchor post was installed into the ground, a 3.0 kN load force was applied and sustained for five minutes, whereby the installed anchor post provided support to the load force.

Example 2: Drive Time Rates for 1500 mm Anchor Posts

In a field test it was found that the time taken to insert a 1500 millimeter anchor post 1500 millimeters into a controlled displaceable ground material offered a significant improvement over existing anchor posts. The controlled displaceable ground material was prepared by making a uniform mixture of composed of wet clay, broken bricks and concrete rubble reasonably well compacted. In controlled tests, a 3.0 kN load was applied at 1.2 m above ground level. The drive time to a working depth for an anchor post length of 1500 mm was found to be about 180 seconds. After the anchor post was installed into the ground, a 3.0 kN load force was applied and sustained for five minutes, whereby the installed anchor post provided support to the load force.

Example 3: The Alignment Element of the Anchor Post

In a field test, it was determined that in various ground conditions, an adjustable alignment element is advantageous. A 160 joule force hydraulic jack-hammer was used to install a 1200 millimeter anchor post into displaceable ground material comprising chalk with flints the size of about 40 millimeters in diameter dispersed throughout the ground material. The flints did cause deflection during the installation of the anchor post, resulting in the anchor post installed into the ground forming less than a 90 degree angle whereby the angle is the angle formed between the anchor post and the surface of the ground. The convex alignment plate of the anchor post was connected to the concave anchor plate of the load post. The concave/convex connection between the anchor post and the load post was utilized to ensure the load post was erected in a vertical manner, whereby the angle formed between the anchor post and the load post after connection and fastening was about 175 degrees.

Example 4: The Alignment Element of the Anchor Post

In a field test, it was determined that when installing the anchor posts described herein in various ground conditions, for example installation into an embankment or slope, an adjustable alignment element is advantageous. A 160 joule force hydraulic jack-hammer was used to install a 1200 millimeter anchor post into an embankment. The convex alignment plate of the anchor post was connected to the concave anchor plate of the load post. The concave/convex connection between the anchor post and the load post was utilized to ensure the load post was erected in a vertical manner, whereby the angle formed between the anchor post and the load post after connection and fastening was about 170 degrees.

Example 5: Installation of the Anchor Post

In various field tests, the anchor posts, as described herein, were installed into the ground. In some situations, a circular shallow pit was formed in the ground where the anchor post was inserted. In other situations, a shallow pit was not formed. Optionally, a CAT scanner was utilized to survey the ground material to determine whether any objects were located within the ground material that may hinder the bottom-driving of the anchor post into the ground. A drive rod was then inserted into the shaft of an anchor post. A percussion-driven hand-held device was then used to bottom-drive the drive rod, which was inserted into the anchor post, into the ground. The anchor post was then driven into the ground until the alignment plate of the anchor post was at ground level. The percussion-driver was then removed, and the drive rod was subsequently removed from the anchor post. A load post was then attached to the alignment plate of the anchor post. The load post was then fastened to the anchor post using bolts, washers and nuts. In situations where a shallow pit was formed prior to installation, the shallow pit was back-filled with the same material that was removed prior to installation. Optionally, during the installation process, a right angle is used to ensure the anchor post and/or load post is positioned in a proper manner.

What is claimed is:

1. An anchor post comprising:

(a) a shaft having a head end and a closed tail end, the shaft configured to connect to a load post;

(b) at least one stabilizing element attached to the anchor post and configured to resist lateral or rotational or non-vertical movement of the anchor post; and;

(c) at least one alignment element that is connected to the head end of the shaft and that is configured to connect to at least one load post.

2. The anchor post of claim 1, wherein the shaft has a cavity configured to receive a drive rod within the shaft.

3. The anchor post of claim 1, wherein the at least one alignment element is configured to connect to the at least one load post without inserting a substantial portion of the load post into the anchor post.

4. The anchor post of claim 1, wherein the at least one stabilizing element is a geometric shape comprising a prism, trapezoidal prism, rectangular prism, triangular prism, a cube, a pyramid, a hemisphere, a barb, or a fin.

5. The anchor post of claim 1, wherein the anchor post is manufactured of a versatile material capable to withstand using a driving force from a hand-held device or a bottom-driven device or a percussion-driven device used for installation of the anchor post into a displaceable ground material.

6. The anchor post of claim 1, wherein the at least one stabilizing element is at least about 2000 $mm^2$ to at least about 150,000 $mm^2$.

7. The anchor post of claim 1, comprising at least two stabilizing elements.

8. The anchor post of claim 7, wherein each of the at least two stabilizing elements is attached to the shaft between about 1 millimeter and about 500 millimeters measured from the head end or the tail end of the anchor post.

9. The anchor post of claim 1, wherein the closed tail end comprises a crimped cross-configuration configured to provide control and direction during installation into displaceable material.

10. The anchor post of claim 1, wherein the at least one alignment element comprises a hole, slot or aperture.

11. The anchor post of claim 1, wherein the at least one alignment element is convex or concave.

12. An anchor post configured to connect to at least one load post comprising:

(a) a shaft having a head end and a tail end, wherein the tail end has a closed crimped configuration;

(b) at least one stabilizing element attached to the anchor post and configured to resist lateral or rotational or non-vertical movement of the anchor post, the anchor post configured to receive a drive rod within a cavity of the shaft at the head end; and (c) at least one alignment element connected to the head end of the shaft that is configured to connect to at least one loadpost.

13. The anchor post of claim 12, wherein the at least one alignment element is configured to connect to the at least one load post without inserting a substantial portion of the load post into the anchor post.

14. The anchor post of claim 12, wherein the at least one stabilizing element is a geometric shape comprising a prism, trapezoidal prism, rectangular prism, triangular prism, a cube, a pyramid, a hemisphere, a barb, or a fin.

15. The anchor post of claim 12, comprising at least two stabilizing elements.

16. A method of installing the anchor post of claim 12, comprising driving the anchor post into a displaceable ground material, applying at least about 3 kN of force to the head end of the anchor post.

17. The method of claim 16, wherein the anchor post is configured for installation into a displaceable ground material at a drive-rate of at least about 5 millimeters of anchor post per second.

18. The method of claim 16, wherein the anchor post is configured for installation into the ground at a drive-rate of at least about 20 millimeters of anchor post per second.

* * * * *